United States Patent [19]

Wall

[11] 4,141,532

[45] Feb. 27, 1979

[54] FRAME STRUCTURE FOR CASTING CONCRETE

[75] Inventor: Harlin J. Wall, State College, Pa.

[73] Assignee: Leisure Life, Inc., State College, Pa.

[21] Appl. No.: 843,344

[22] Filed: Oct. 18, 1977

Related U.S. Application Data

[63] Continuation-in-part of Ser. No. 741,016, Nov. 11, 1976, abandoned.

[51] Int. Cl.[2] ..... B28B 7/22

[52] U.S. Cl. ..... 249/94; 249/112; 249/126; 249/134; 249/156; 249/163

[58] Field of Search ..... 249/13, 18, 94, 97, 249/112, 126, 134, 163, 187–189, 165

[56] References Cited

U.S. PATENT DOCUMENTS

| | | | |
|---|---|---|---|
| 3,161,938 | 12/1964 | Graham | 249/13 |
| 3,381,929 | 5/1968 | Bancker | 249/189 |
| 3,810,601 | 5/1974 | Miram | 249/188 |
| 4,017,051 | 4/1977 | Scott et al. | 249/134 |

*Primary Examiner*—Richard B. Lazarus

*Assistant Examiner*—John McQuade

*Attorney, Agent, or Firm*—Wenderoth, Lind & Ponack

[57] ABSTRACT

A frame structure for casting a concrete building panel has a plurality of panel edge molding frame members with a generally U-shaped cross-section, a plurality of panel corner frame members with a configuration which corresponds to the angle of the corner of the panel. A number of edge molding frame members and the corner frame members are assembled in a panel molding frame with a length and width corresponding to the length and width of the panel to be molded with the ends of the edge molding frame members connected by the panel corner frame members, and with the opening of the U-shaped cross-section facing inwardly of the panel molding frame. Connectors rigidly connect the edge molding frame members to each other and to the panel corner frame members and a liner structure is provided in the interior of each of the edge molding frame members. The surfaces of the liner structure facing the space within the panel molding frame has a shape complementary to the shape of the edge of the panel to be molded.

43 Claims, 23 Drawing Figures

FRAME STRUCTURE FOR CASTING CONCRETE

This application is a continuation-in-part of application Ser. No. 741,016, filed Nov. 11, 1976, now abanboned.

This invention relates to a frame structure for casting a concrete building panel, and more particularly relates to such a frame structure which is made of light weight extruded frame members having therein liner means with surfaces facing the interior of the frame which have a shape complementary to the shape of the edge of the concrete panel to be cast by using the frame structure.

BACKGROUND OF THE INVENTION AND PRIOR ART

In the building industry, and particularly the art of prefabricated concrete building structures, it has been known for some time that in order to avoid the cost of transporting rather large and heavy precast concrete panels from a central point at which they are manufactured in a casting plant to the site of the concrete building structure, that the panels could be cast at the site. The method developed involves forming conventional wooden forms in the shape of generally rectangular frames corresponding to the shape of the concrete panel and laying one of these frames on a flat base and casting the panel within the wooden form. In order to conserve space, the method has been developed of covering the lowermost such cast panel with a parting material, such as a sheet of plastic, and casting a second panel on top of the first panel, and proceeding to cast a series of panels in a stack. After the panels have cured, they can be unstacked and the wooden forms removed, and the panels can be incorporated into the building structure.

However, as the art of prefabricated concrete building structures has improved, methods have been developed for directly joining the edges of the panels to each other and filling the joints with a grouting material for sealing the joints, to facilitate the erection of the building. Such panels must have specially shaped edge portions in order to make it possible to joint the panels together directly into the finished concrete building structure. The method of precasting the panels at the site of the building structure has been difficult to adapt to the casting of such specially shaped panels.

In U.S. Pat. No. 2,940,295, there is disclosed pre-cast edge frames of concrete which are pre-cast, and then the frame members are arranged in a frame, the exterior peripheral edge of which has a plain flat shape. Then the center portion of the panel is cast into the thus formed frame, which frame serves as the form for the concrete for the center portion of the panel and also becomes the peripheral edge of the finished panel. It is conceivable that the outer peripheral edges of the frame in this patent could be given the desired shape when they are initially cast, and then these frame members could be transported to the construction site and used as the forms for the panels in place of the wooden forms. The edges of the finished panels could thus be given the desired shapes.

While this would be an improvement over the prior art methods, such a system would still require a central casting plant and still necessitate the transport of the pre-cast concrete frame members to the site of the building structure. Where the site of the building structure is relatively close to the casting plant, this might not involve any great expense or difficulty. However, where the concrete structure is to be erected at a site remote from the central casting plant, the transport of the precast concrete frame members might create considerable difficulty, and involve considerable expense.

Moreover, such a system would involve the formation of a joint between the pre-cast concrete frame members and the central portion of the panel. Care would have to be taken during the casting of the panels at the building site to insure that this joint was properly formed so as not to leave an aperture of any kind or a weak portion of the finished panel.

OBJECTS AND BRIEF SUMMARY OF THE INVENTION

It is an object of the present invention to provide a frame structure for casting a concrete building panel, preferably at the site of the building structure itself, which overcomes the drawbacks of the prior art.

It is a further object of the present invention to provide usch a frame structure for casting a concrete panel which is light in weight and can therefore be easily and inexpensively transported to any building site, and yet which can be assembled in a way so as to cast a panel having any desired shape of the edge thereof.

It is still a further object of the invention to provide a frame structure for casting a concrete panel which is easy to use and can be easily handled by only two men in assembling the frame structure for the casting of a concrete panel.

It is a still further object of the present invention to provide the frame structure for casting the concrete building panel, the major portions of which can be reused again and again to cast concrete panels.

These objects are achieved by a frame structure according to the present invention for casting a concrete building panel, which comprises a plurality of panel edge molding frame members each having a generally U-shaped cross-section;

a plurality of panel corner frame members each having a configuration which, when viewed in plan, corresponds to the angle of the corner of the panels to be molded thereby, said panel edge molding frame members and said panel corner frame members being assembled in a panel molding frame with a number of panel edge molding frame members along the portions of the frame corresponding to the edges of the panel to be molded sufficient to equal the length of the corresponding edge of the panel, with the ends of the panel edge molding frame members abutting the panel corner frame members and with the opening of the U-shaped cross-section of said panel edge molding frame members facing inwardly of the panel molding frame;

connecting means rigidly connecting said panel edge molding frame members to each other and to said panel corner frame members; and liner means in the interior of each of said panel edge molding frame members and having the inner portions thereof abutting the interior of said frame members for positioning said liner means in the frame members, and the surfaces of the liner means facing the space within the panel molding frame together having a shape complementary to the shape of the edge of the panel to be molded with said frame structure.

The liner means can be liners molded of an easily moldable material and inserted into said panel edge molding frame members and retained therein by retaining means within the panel edge molding frame members, or the liner means can be a coating of easily moldable material softer than the material of the frame members and having varying thicknesses.

The same molding frames are used to carry out casting of stacks of panels are described hereinbefore.

BRIEF DESCRIPTION OF THE FIGURES

Other and further objects of the invention will become apparent from the following description of a preferred embodiment of the invention, taken together with the accompanying drawings; in which.

DETAILED DESCRIPTION OF THE INVENTION

The frame structure for casting a concrete building panel according to the present invention has, as the basic elements thereof, a plurality of panel edge molding frame members, a plurality of panel corner frame members, connecting means connecting the panel edge molding frame members and panel corner frame members together, and liner means in the panel edge molding frame members.

Figure 1:
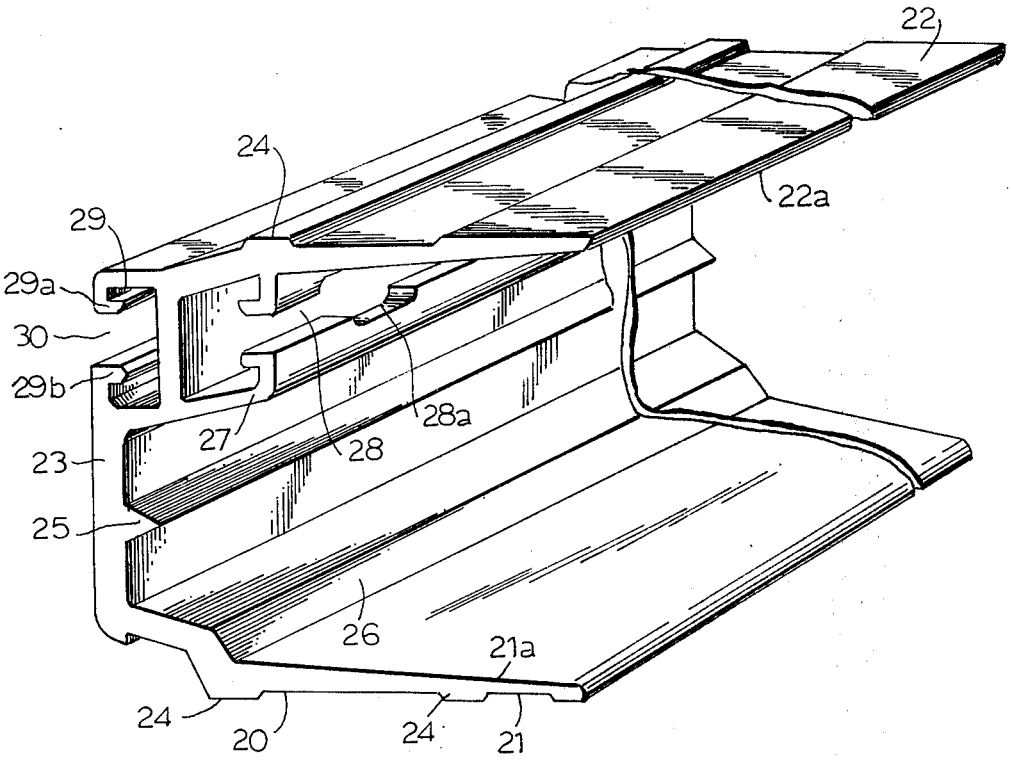
FIG. 1 is a perspective view of a panel edge molding frame member forming part of the frame structure of a first embodiment of the present invention.
Figure 2:
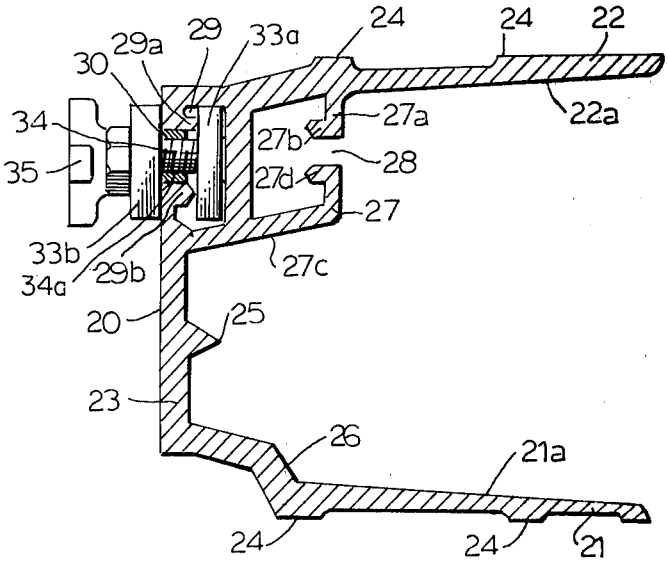
FIG. 2 is a sectional view of the frame member of FIG. 1.

In a first embodiment of the invention, as shown in FIGS. 1–12, the panel edge molding frame members 20 are shown in FIGS. 1 and 2. These panel edge molding frame members 20 have a generally U-shaped cross-section defined by two side members 21 and 22 and a bottom member 23. The side members have opposed inner surfaces 21*a* and 22*a* which are tapered outwardly toward the open part of the U-shaped cross-section. On the outer surface of the sides 21 and 22 are flats 24 which, when the frame members 20 are stacked one on the other as will be described in detail hereinafter, abut each other. A pointed rib 25, the purpose of which will be defined hereinafter, is provided along the inner surface of the bottom member 23. A liner abutment means is provided within the frame member 20, and in the embodiment shown takes the form of an abutment 26 extending along the frame member between the bottom member 23 and the side member 21.

The first embodiment of the invention has, in the inner portion of the U-shaped cross-section, a liner retaining means, here shown in the form of an inner channel portion 27 which has a slot-shaped opening 28 therein directed toward the open part of the U-shaped cross-section. The inner channel portion 27 is defined by a depending flange 27*a* having the lower end 27*b* bent inwardly into the interior of the channel portion 27, and an outwardly and upwardly projecting flange 27*c* having an inwardly turned edge 27*d*. The inwardly turned edges define the opposite sides of the slot 28. At intervals along the slot 28 are slot enlargements, as shown in 28*a* in FIG. 1, for a purpose to be described hereinbelow.

On the outside of the channel member 20 of the first embodiment is an outer channel 29 having a slot 30 opening out of the channel 29. The edges of the frame member defining the slot 30 are turned inwardly at 29*a* and 29*b*.

It will be seen that the frame member 20 is thus in the shape of a channel member, and in the first embodiment of the invention, this is an extruded aluminum channel member having a length of up to 14 feet. When extruded in a gauge having sufficient strength to support concrete in a panel having a thickness of 6", the 14 foot long frame member weights approximately 110 pounds, which is easily handled by two men. Alternatively, other molded or extruded metals can be used, or rigid molded or extruded plastic materials, such as urethane resin or polyurethane, can be used.

Figure 6:
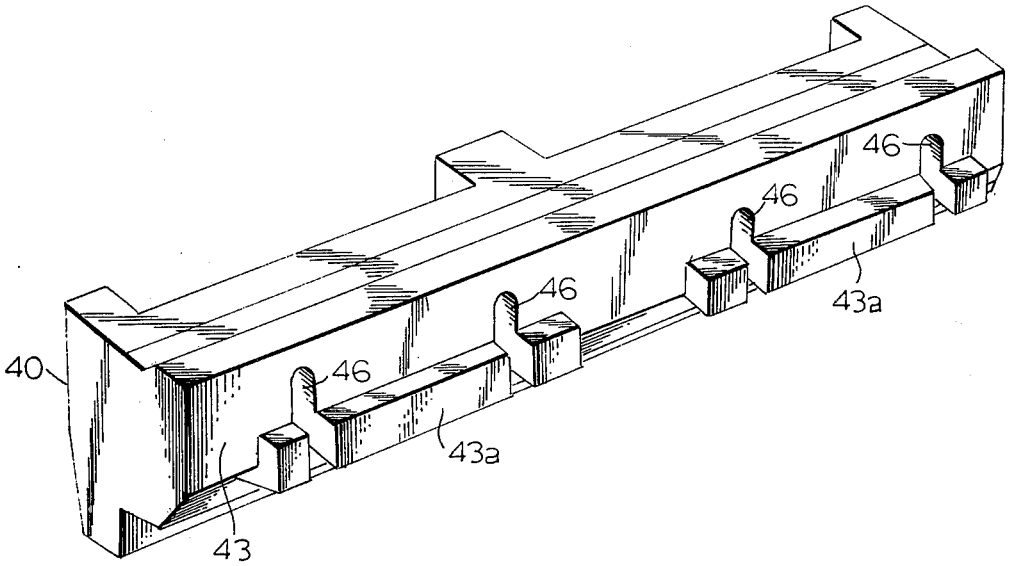
FIG. 6 is a perspective view of the opposite side of the liner of FIG. 3.
Figure 7:
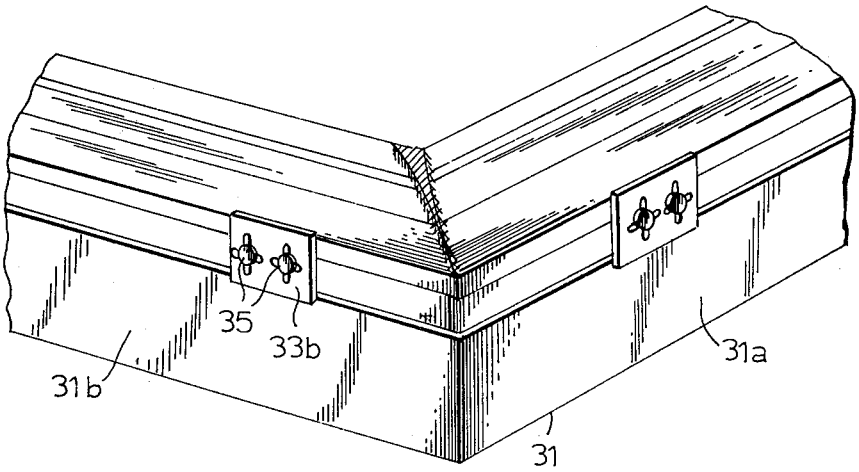
FIG. 7 is a perspective view of a panel corner molding frame member forming part of the frame structure of the first embodiment of the present invention.

In order to form the corners of the panels, there are provided panel corner frame members 31, as shown in FIG. 7. These corner molding frame members each have two portions 31*a* and 31*b* which have the same cross-section as the panel edge molding frame members, as shown in FIG. 2. These portions are abutted at one end thereof to each other and are attached to each other at an angle corresponding to the angle of the corner of the panel to be molded thereby. In the specific form as shown in FIG. 6, the portions 31*a* and 31*b* are welded to each other to form a 90° corner.

Figure 12:
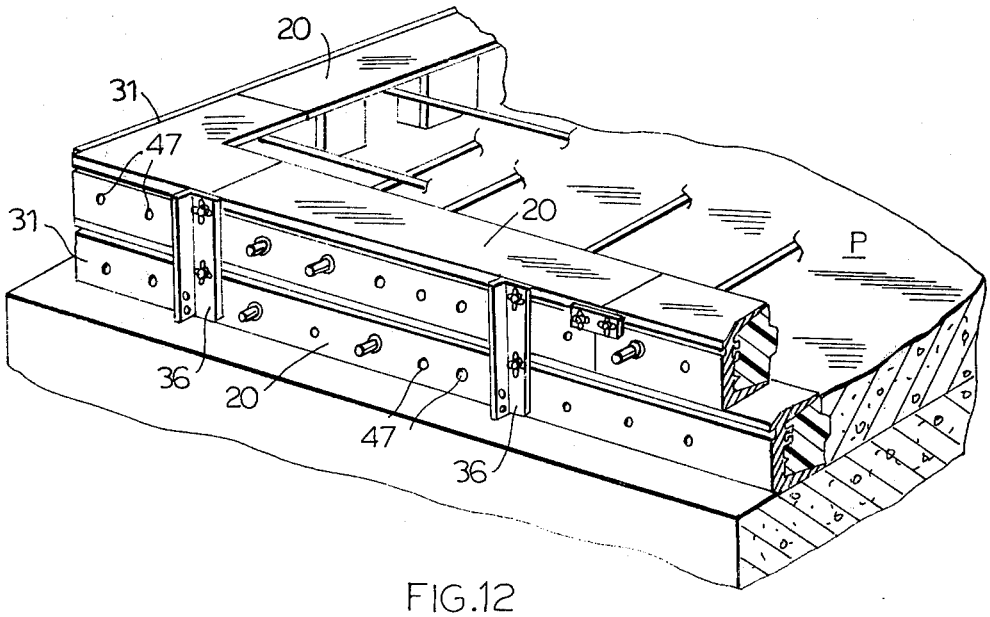
FIG. 12 is a partial perspective view of the frame structure in position on a base preparatory to the casting of a concrete building panel.

It will thus be seen that the panel edge molding frame members and panel corner frame members can be assembled together into a panel molding frame, as shown in FIG. 12, in which there is a panel corner frame member 31 at each corner of the frame, and there is one or more panel edge molding frame members 20 between each two adjacent panel corner molding frame members 31. In the spcific frame shown in FIG. 12, the panel is to be rectangular, and there is a single panel edge molding frame member extending across the short side of the panel molding frame between two adjacent panel corner frame members 31, and there are two panel edge molding frame members 20 extending in the direction of the long side of the panel molding frame between adjacent panel corner frame members 31. It will be obvious to those skilled in the art, however, that a square panel could be molded simply by making the number of panel edge molding frame members the same on each side of the panel molding frame, or other relative dimensions could be obtained by inserting the proper number of panel edge molding frame members 20 between adjacent panel corner frame members 31. Moreover, the panels need not be rectangular, and panel corner frame members 31 having the portions abutted at different angles could be used to form shapes such as triangular panel molding frames, hexagonal panel molding frames and the like.

In order to join the panel edge molding frame members 20 to each other and to the panel corner frame members 31, connecting means is provided as shown in FIGS. 2 and 7. The connecting means is constituted by a bar 33*a* which is positioned in the outer channel 29 over the inside of the slot 30 and a plate 33*b* positioned over the outside of the slot 30, and the bar and the plate extend between an abutting pair of frame members 20, or an abutting frame member 20 and a portion of the panel corner frame member 31, across the joint between the members. Threaded through the bar 33*a* and plate 33*b* in each of the abutting frame members on opposite sides of the joint is at least one threaded shaft 34 having a handle means 35 thereon for rotating the shaft. It will be seen that by threading the shaft 34 through the bar 33*a* against the innermost surface of the channel 29, the bar 33*a* is forced against the inturned edges 29*a* and 29*b*, and the plate 33*b* is drawn tightly against the outside of the frame member, thus securely fixing the bar 33*a* and the plate 33*b* to the frame members 20, or the panel corner frame member 31. By fixing the bar 33*a* and plate 33*b* in both of the abutting frame members, the two frame members are secured together, and since the bar 33*a* substantially fills the channel 29, the abutting frame members will be substantially perfectly aligned with each other in the direction of the length of the frame members. A roller 34*a* around each shaft 34 enables the connecting means to move easily along the slot 30.

Figure 8:
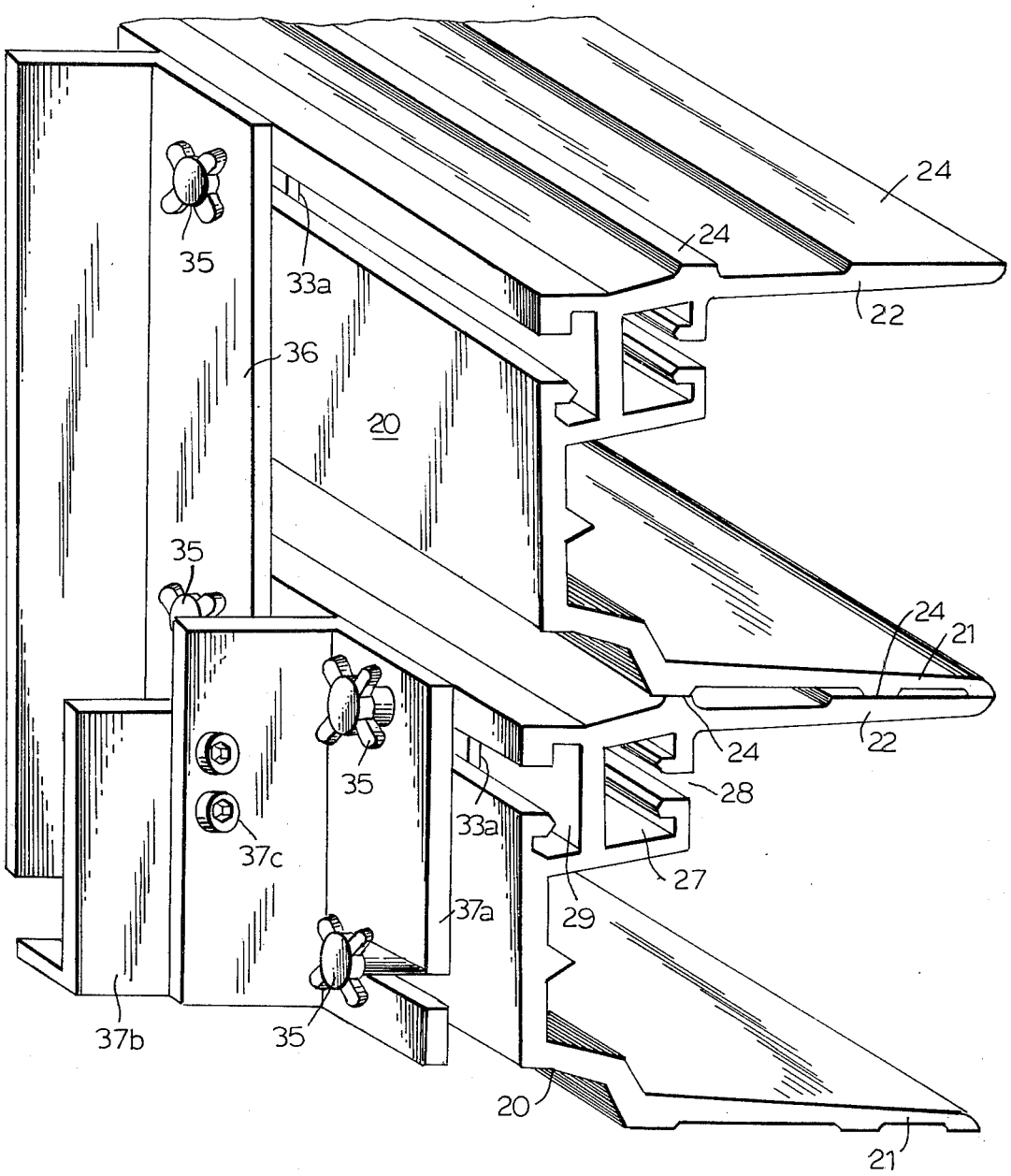
FIG. 8 is a perspective elevation view of portions of two frame members such as shown in FIG. 1 stacked on each other and connected by stacking connecting means.

In order to hold frame members which have been stacked one on top of the other with the flats 24 on the upper frame member resting on the corresponding flats on the lower frame member, as shown in FIGS. 8 and 12, for purposes which will be discussed in greater detail hereafter, there is provided at intervals along the frame members a stacking connecting means in the form of a plate 36 having apertures therein spaced a distance equal to the distance between the channels 29 in frame members stacked one above the other. Threaded shafts 34 with handles 35 thereon are provided in each aperture and a bar like the bar 33*a* is provided in each channel 29. By passing the threaded shafts 34 through the apertures in the plate 36 into the bars 33*a* and by tightening the handles against the plate 36, the plate will be clamped to the outer surfaces of the upper and lower frame members, thus fixing the lower and upper frame members to each other.

In order to adjust the vertical positions of the frame members 20 relative to each other, it may be desirable to provide shims (not shown) between the frame members. In this case, additional holes must be provided in the plate 36, as will be readily apparent to those skilled in the art.

There is also preferably provided an anchoring means constituted by two angle plates 37*a* and 37*b*. Angle plate 37*a* has two vertically spaced holes therein each having a threaded shaft 34 with a handle 35 thereon extending therethrough. The upper shaft 34 extends through slots 30 into channel 29 where it engages in plate 33*a* as described above for the connecting means. The lower shaft 34 is threaded into a tapped hole in frame member 20. Angle plate 37*b* has one side secured, for example by rivets 37*c*, to the outwardly projecting portion of angle plate 37*a*, with the other side of plate 37*b* horizontal so that it can be secured by bolts, for example, to a supporting base.

Figure 3:
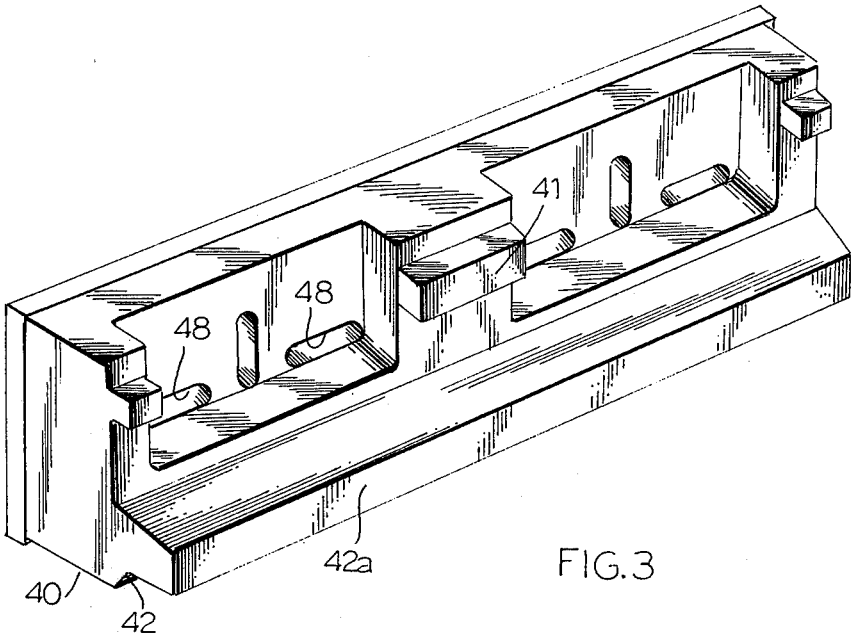
FIG. 3 is a perspective view of a liner for insertion into the frame member of FIGS. 1 and 2.
Figure 4:
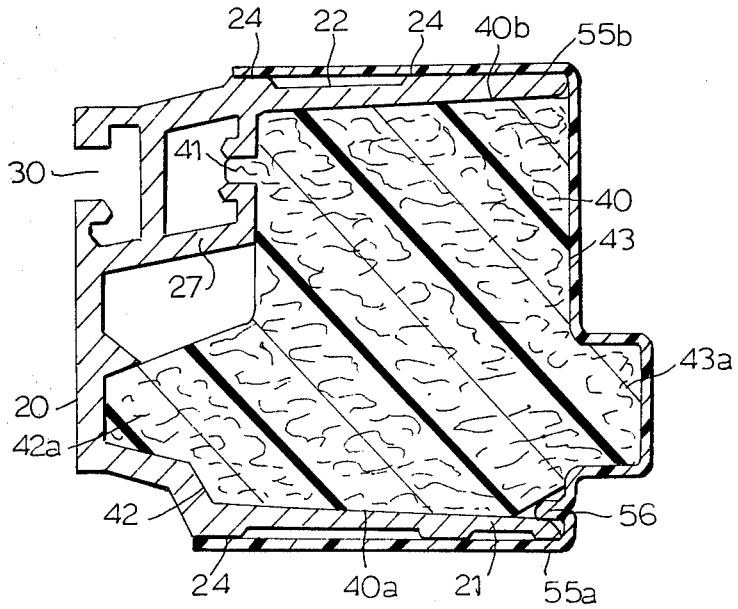
FIG. 4 is a sectional view similar to FIG. 2 with the liner in position in the frame member.

The final essential element of the frame structure according to the present invention is the liner means which is provided for each frame member 20 and, in the first embodiment, for each panel corner frame member 31. As shown in FIGS. 3 and 4, the liner means is in the form of a liner 40 having a shape with the surfaces 40*a* and 40*b* thereof which engage the inner surfaces 21*a* and 22*a* of the side members 21 and 22 of the frame members 20 and 31 which are substantially complementary to the surfaces 21*a* and 22*a*, i.e., which taper at substantially the same angle as the surfaces 40*a* and 40*b*. On the face of the liner 40 which is toward the innermost part of the frame member 20 or 31 is at least one projection 41 substantially aligned with an enlargement 28*a* in slot 28 in the inner channel portion 27, and tightly engaged in the slot enlargement 28*a* for retaining the liner 40 within the frame member. By placing the enlargements at intervals along the liner 40 corresponding to the intervals at which the enlargements 28*a* are located, the projections cooperate with the enlargements 28*a* both to retain the liner in the frame member and to positively locate the liner in the lengthwise direction relative to the frame member.

The liner 40 has a lower corner edge 42 which has the shape as shown in FIGS. 3 and 4 and which fits against the abutment 26 to limit the distance which the liner 40 can be inserted into the frame member. In addition, a projecting rib 42*a* along the lower portion of the face of the liner which faces the bottom 23 of the frame member 20 projects into the recess between the pointed rib 25 and side member 21 to further locate the liner 40 in the frame member 20.

It will thus be seen that the liner 40 is substantially wedged into the frame member 40, and retained therein by the engagement of the projection 41 in the slot enlargements 28*a*. The distance the liner 40, as shown, can move into the frame member 20 is limited by the abutment of the corner 42 with the abutment 26 and projecting rib 42*a* with the bottom 23. The liner 40 is thus securely positioned, and yet can be easily withdrawn in the direction of the open end of the U-shaped cross-section because the surfaces 21*a* and 22*a* and the complementary surfaces 40*a* and 40*b* are tapered utwardly toward this opening.

The liner 40 is preferably of a material which is softer than the material of the frame members, and in the most preferred embodiment of the invention, the liner is of expanded polystyrene. The liner can also be of so-called rubber urethane, either foamed or unfoamed. Thus, the liners 40 can be easily molded to the desired shape, and yet they are relatively inexpensive and extremely light weight. They can thus be used as throw away inserts for insertion into the frame member 20, and yet they are extremely easy to handle and to ship. In practice, where the liners are not protected from contact with the concrete, they can be used to cast one panel and then discarded. The frame members can be used over and over again. Thus, for a complete building, there must be provided a complete set of liners, i.e., for all the edges of the panels. However, only enough frame members are needed to form three, four or five panels, and these are used over and over, as will be described hereinafter.

By making the material of the liner softer than the material of the frame member, which is preferably aluminum, the projections 41 can be made slightly larger than the width of the enlargements 28*a*, and the projections 41 are then slightly crushed as they are forced into the slot 28 so as to securely retain the liner 40 within the frame member.

Figure 9:
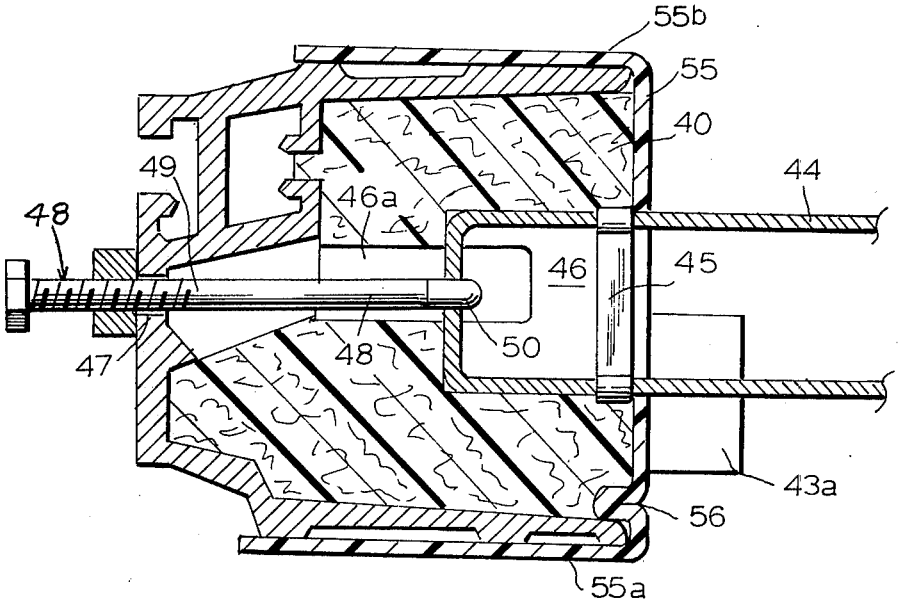
FIG. 9 is a sectional view of a frame structure of the first embodiment to the present invention with a liner therein and reinforcing rods locked in position therein.
Figure 10:
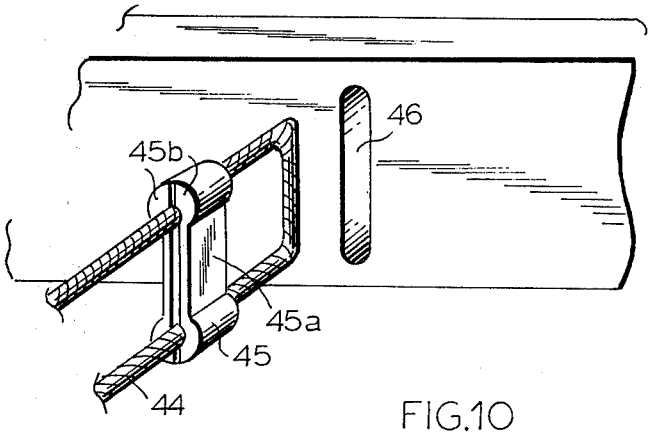
FIG. 10 is a fragmentary perspective view showing how the reinforcing rod of FIG. 9 is inserted into the recess in the liner.

The surface 43 of the liner 40 facing the space within the panel molding frame is shown in FIGS. 4 and 6 as being substantially flat with projections 43*a* along the lower edge thereof, and the corresponding edge of the concrete panel will thus be substantially flat with corresponding recesses therein. However, the liner 40 can be formed so as to give the shape of the surface 43 any desired shape and the corresponding edge of the cast panel will then have a complementary shape. In addition, vertically extending recesses such as apertures 46 can be provided in the liner 40 into which the closed ends of loop-shaped reinforcing rods 44 can extend into the space within the frame, as shown in FIGS. 6, 9 and 10. Preferably plugs 45 of rubber, plastic or the like, are placed on the reinforcing rods 44, as shown in FIGS. 9 and 10, to plug the portion of the recess 46 not occupied by the rod 44 to block entry of concrete into the recess. The plugs 45 each have a body 45*a* and opposed cup-shaped flaps 45*b* on each end of the body which flaps cooperate to grasp the reinforcing rod 44 to position the plug thereon. With this arrangement, when the liners are removed from the cast panel, as will be discussed below, the loops of reinforcing rod will project from the edge of the panel. The reinforcing rod loops 44 are anchored by anchors 48 extending through corresponding apertures 47 in the bottom member 23 of the frame 20 or corresponding apertures 47 in the frame portions of the panel corner molding frame member 31 and recesses 46*a* in the liner 40 which intersect the recesses 46. The anchors 48 each have a shank 49 with a hook 50 on the inner end which hooks into the looped reinforcing rod 44 in recess 46, the recess 46*a* being sufficiently large to accommodate hook 50. The other end of the shank has fastening means such as a nut 51 threaded thereon for drawing the hook 50 into tight engagement with the reinforcing rod 44 and drawing the reinforcing rod into the bottom of recess 46. Thus, the anchors 48, when they are tightened, hold the assembly of the frame member 20 or 31, the liner 40 and the reinforcing rod 44 together.

Moreover, gaps can be left between the liners 40, in which case the inner surface of the frame member will then serve as the form for the edge of the panel. In such a case, the projections 42*a* on the liner 40 on either side of the gap will extend to rib 25 and cooperate with the lower face of the rib 25 to form a relatively thin edge projection on the edge of the finished concrete panel.

In order to protect the surface 43 of the liner 40 which faces the inside of the frame member 20 and which will contain the concrete of the cast panel from the effects of the concrete and to keep the concrete out of contact with the aluminum of the frame members 20 and 31, there can be provided a protector 55, best shown in an exaggerated thickness, in FIGS. 4 and 9. This protector is a sheet of plastic material, such as polyethylene, which has been molded to a shape corresponding to the shape of the surface 43, that is with the projections 43*a*, or any other projections or recesses or the like present on the surface 43 and which has the ends 55*a* and 55*b* molded in a shape for fitting snuggly around the ends of the side members 21 and 22 of the frame members. The ends 55*a* and 55*b* extend back from the ends of the side members 21 and 22 at least to the rearmost flats 24 to protect the top and bottom surfaces of the frame members 20 and 31 from the concrete cast into the center of the frame to form the panel. Preferably, the protector 55 has a groove 56 in the portion thereof just inside the end of the side member 21 for accommodating a strip of rubber or like sealing material which is held therein during the casting of the panel so as to provide a sealing gasket along the edge of the finished panel for engagement with the next adjacent panel in a finished building structure.

Figure 5:
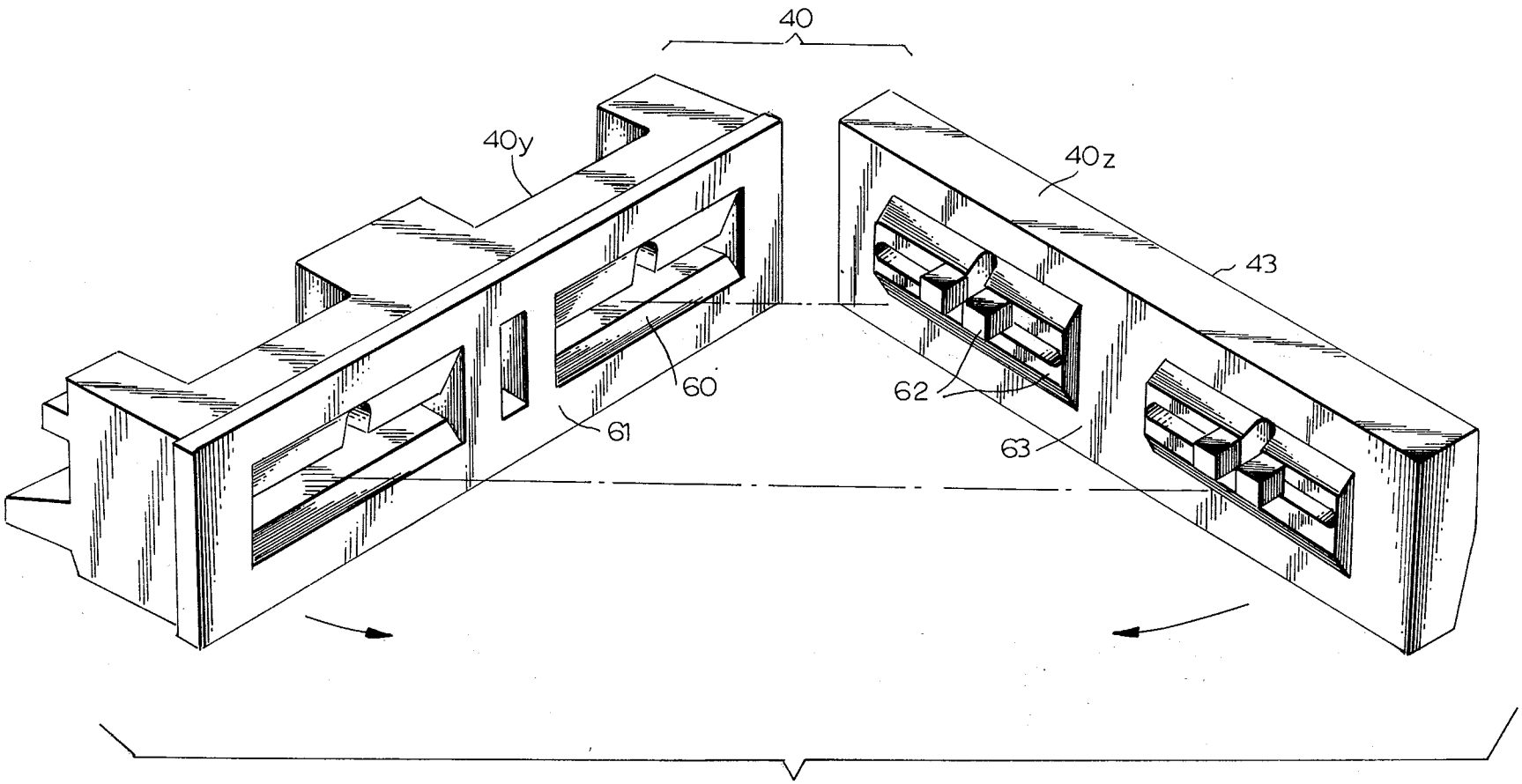
FIG. 5 is an exploded perspective view of a two part liner showing the mating portions thereof.

The liner 40 has been shown in FIGS. 3, 4, 6 and 9 as being a single piece element, and the liner can be used as a single piece very satisfactorily. However, it is desirable for some purposes to change the position of the surface 43 of the liner so as to make it lie within the frame member 20 or 31 or so as to make it project beyond the ends of the side members 21 and 22 of the frame members 20 and 31. In order not to have to have a large inventory of liners of various thicknesses, the liner can be made in two parts, as shown in FIG. 5, an inner, with respect to the bottom of the frame member 20, part 40*y* and an outer part 40*z*. The inner part has recesses 60 in the outwardly facing surface 61 thereof, while the outer part 40*z* has complementary projections 62 on the inwardly facing surface 63 thereof for holding the parts in the proper relative positions within the frame member. Naturally, the positions of the complementary recesses 60 and projections 62 can be reversed. In this way, a relatively small number of inner parts 40*y* can be provided, all the same size, and a large number of different sizes, particularly different thicknesses, of outer parts 40*z* can be provided so that the position of the outer surface 43 of the liner can be located at any one of several locations.

Figure 11:
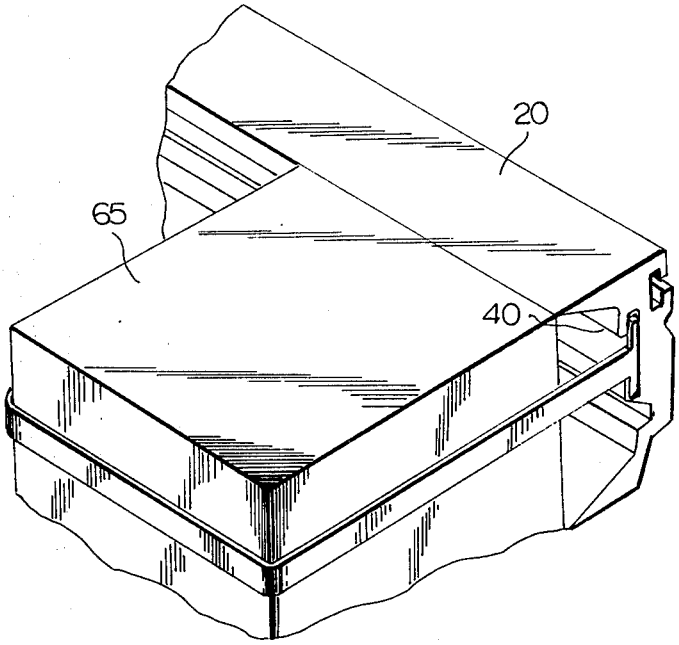
FIG. 11 is a perspective view of a liner attachment for forming an edge recess in a panel and attaching to a frame member.

In the event that it is desired to provide an edge recess in an edge of the panel, an edge recess form 65, as shown in FIG. 11, can be provided which has a shape complementary to the desired shape of the recess, and this form can be secured to the frame 20 and 31 by a flexible strap 66 extending around the periphery of the form and having anchor elements 67 on the ends thereof anchored in the inner channel portion 27. A simple T-shaped anchor element 67 will suffice, it simply being necessary to turn the T-shaped portion parallel to the slot 28 and insert it through the slot and allow it to turn perpendicular to the slot 28.

Thus, by the combination of the liner and the internal surface of the frame member, substantially any desired shape can be given to the edge of the cast panel. It requires only molding of the liner 40 with the proper shape of the surface 43, or providing apertures or gaps at proper places in the liner 40 or between the adjacent liners 40, for providing the proper shape to the edge of the cast panel. It will be readily understood that indicator markings and matching markings can be provided on the edge of the cast concrete panel by providing appropriate shapes to the liner 40.

The frame members 20 and 31 can obviously have liners 40 therein, some of which have different shaped surfaces 43 from the others. Therefore, by providing an appropriate series of liners, a panel can be cast having the desired shape of the edge thereof for mating with any type of adjacent panels.

As shown in FIG. 12, after one panel P has been cast, a second set of frame members 20 and 31 is positioned on top of the frame members 20 and 31 for the first panel by stacking connecting means 36, with a parting sheet therebetween, for example of plastic, and after sufficient time has been allowed for the first panel P to set, the second panel can be cast. The frame members of the second panel are held in the proper position by the connecting means 36 as shown and described in connection with FIG. 8. After the first panel has set sufficiently so that it will maintain its shape and support the weight of another panel, the frame members 20 and 31 can be pulled laterally off the liners 40, leaving the liners 40 temporarily attached to the edges of the panels. The thus removed frame members can then be used for casting a third or fourth panel up in the stack in the same manner that the second or third panel is cast. Beginning with the third panel in the stack and all those thereabove, the frame members on the last panel cast are supported on the reinforcing rods 44 embedded in the cast panel, and the frame members for the next panel to be cast will in turn be supported by the frame members for the last panel cast.

After the panels have completely set, they can be handled in the usual way for erecting into a concrete building structure. During the handling of these panels, and up until they are placed in position, the liners can, if desired, be left attached to the panels, so as to prevent physical damage, such as chipping, to the edges thereof. Just before the panels are placed in their final position, the liners can be removed by simply pulling them off.

If the protectors are used, both the liners 40 and frame members 20 and 31 will be protected from the concrete. When the liners 40 are removed, the protectors can remain on the edges of the panel for temporary protection thereof and thereafter be discarded.

Thus, the interior surface of the frame members 20 and 31 do not become as dirty as conventional concrete forms. They are much easier to keep clean and in good condition for reuse, and can be used almost indefinitely.

Since frame members need not be cleaned extensively between uses, the recycling of the frame members for further casting operations can be carried out in an extremely short time as compared with conventional forms for use in casting concrete. Where the protectors 55 are used, the liners 40 can also be reused a number of times, thereby reducing the size of the inventory of liners necessary for a given building structure.

If it is desired to cast a panel with a thickness greater than that of the dimension of the frame members 20 and 31 in the direction of panel thickness, the shims mentioned hereinbefore can be provided between the stacked frame members, and appropriate means provided for preventing the concrete from escaping between the frame members.

The liners, being made of polystyrene, can be cut to any desired lengths simply by using a hot wire. It is simple to form mitered corners for insertion into the panel corner molding frame members 31. Since all of the parts are interchangeable, the details of the edges of the panel can be chosen as desired and to meet extremely complex design requirements for abutting panels of concrete which have different functions in the completed concrete building structure.

Since the liners are of a material such as polystyrene, they are inexpensive, and disposal thereof after they have been used a few times is not costly.

A further advantage of leaving the polystyrene liners or protectors on the edges of the panels after removal of the frame members, in addition to protecting the edges of the panels from physical damage, is that they slow the escape of moisture from the concrete, and further insulate the concrete from freezing during extremely cold weather.

Since the liners are disposed of after a few uses, they do not become worn, and the edges of the cast panels are always given the proper form because new liners are used for each casting operation.

It is also possible, instead of removing the liners from the edges of the cast panels, to leave the expanded polystyrene liners in place in the finished concrete building structure in order to provide for thermal insulation, or to absorb certain structural deflections which may occur in floor and roof panels, for example.

The overall system from which the frames are made for a complete building structure not only occupies a relatively small space for purposes of shipping, but is relatively light in weight. In one practical embodiment of the first embodiment of the invention, it has been found that the form system, including the frame members, liners, protectors and connecting bars, and the reinforcing and post-tensioning steel for a 20,000 square feet building can be packed and shipped in one Sea Land container.

Further, the cross-sectional shape of frame members 20 and 31 is such as to not only support and align liners 40, but also to cooperate with the liners 40 having a variety of configurations to create an interaction between elements 20, 31 and 40 and thereby provide numerous concrete profiles necessary for the structural connections of the final concrete structure. In actual building practice, these profiles cannot be formed by either the frame elements 20 and 31 alone, or liner 40 alone. It is only by the interaction of all these elements that a practical system of casting the panels is achieved.

In the use of the first embodiment, it is preferable that the panel edge molding frame members 20 be kept out of contact with the concrete being cast, so that in the frame structure of that embodiment, in each instance a liner 40 will be inserted into the frame member and subsequently removed from the frame member when the frame structure is disassembled. While this gives good flexibility insofar as using different shaped liners for making panels with different shaped edges, there is a tendency for the outsides of the frame members and the edges to have concrete adhere thereto, so that an inordinate amount of time is spent cleaning the frame members.

The system can be modified to provide a different form of liner means which is permanently attached to the frame members, thereby reducing the number of parts necessary for forming a concrete building panel and reducing the amount of concrete adhering to the frames. An embodiment in which the different form of liner means is used is shown in FIGS. 13*a*–19*c*.

Referring to FIGS. 13*a*–15, it will be seen that the panel edge molding frame member generally indicated at 120 has a generally U-shaped cross-section defined by two side members 121 and 122, and a bottom member 123. In the form shown in FIG. 13*a* the frame member is a single integral piece, while in the form shown in FIG. 13*b*, the frame member is made of three pieces welded together.

A liner means in the form of a coating 140 of a moldable material which is relatively soft as compared to the material of the frame member 120 itself and which is resistant to attack by concrete, which is abrasion resistant and which is resistant to release agents for releasing concrete, is molded over the outer surface of the side members 121 and 122, and the inner surface of the side members 121 and 122 and the bottom member 123. The coating 140 has a varying thickness for providing the desired shape of the surface 140*a* which faces the space within the panel molding frame, said surface having a shape different from the shape of the interior of surface of the frame member 120. For example, the coating 140 in FIG. 13*b* has a thick portion 140*b* along the inside of the bottom member 123 with a recess 140*c* at the lower part thereof, while the coating 140 in FIG. 13*a* has a thin portion 140*d* at the same location and no recess.

Figure 13A:
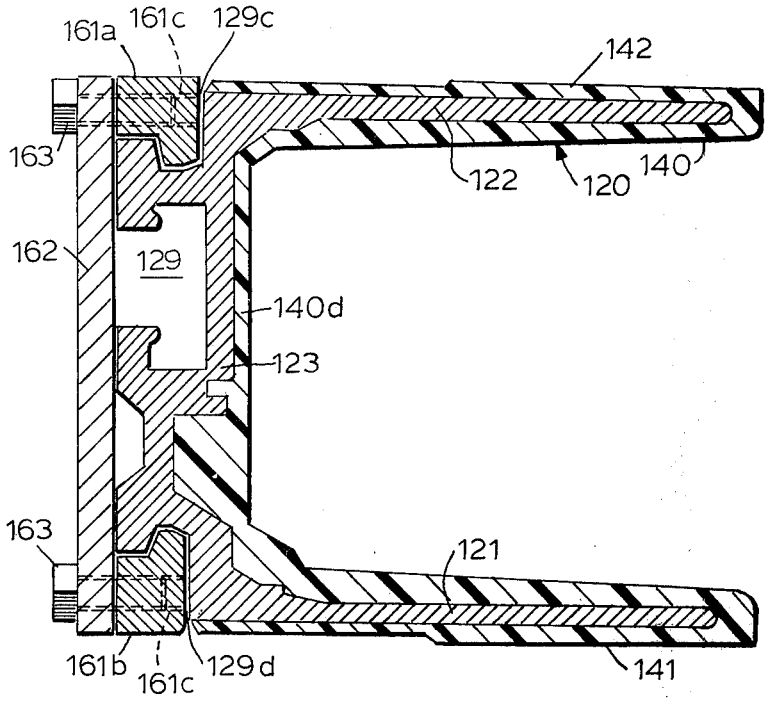
FIGS. 13*a*–13*c* are sectional views of three forms of a panel edge molding frame member forming part of the frame structure according to a second embodiment of the present invention.
Figure 13B:
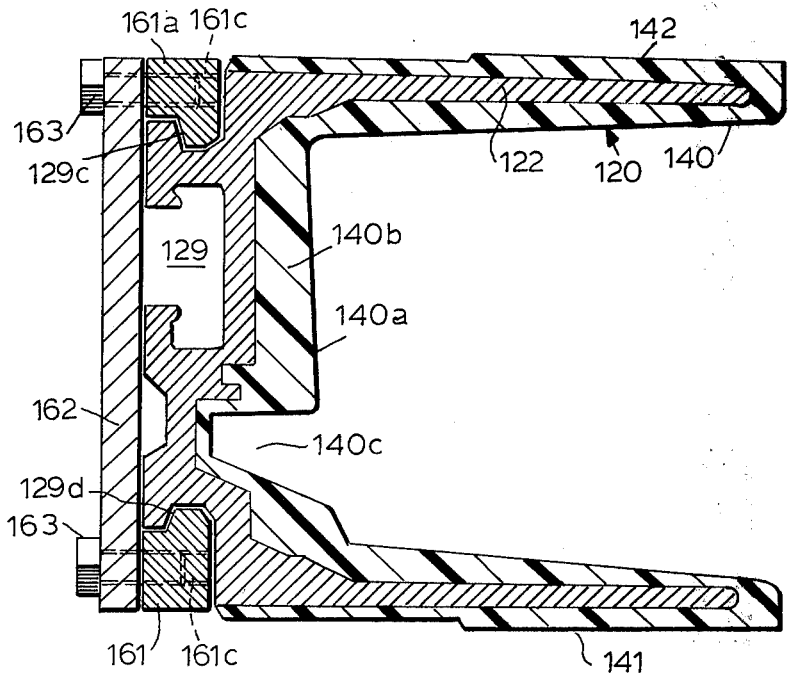
Figure 13C:
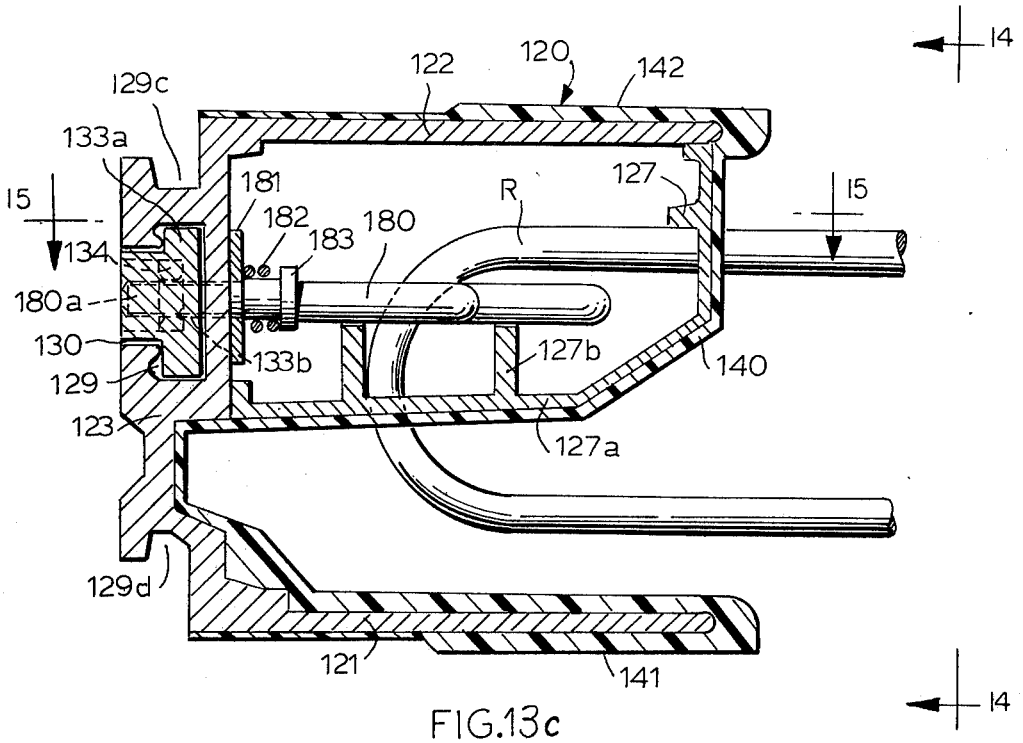

A preferred material for this coating is polyurethane having a hardness of about 80 Shore A and the coating 140 is bonded to the metal of the frame member by a conventional adhesive for adhering polyurethane or the like to metal. The coating 140 is molded to the frame member so as to provide flats 141 and 142 on the exterior surfaces of the side members 121 and 122, which flats, when the frame members 120 are stacked one on the other as will be described in detail hereinafter, abut each other. The inner surface of the coating 140 on the inner surface of side members 121 and 122 of FIGS. 13*a* and 13*b* is tapered toward the opening of the frame. Mounted within the interior of the frame member 120 having the form shown in FIG. 13*c* is a filler 127 which extends from the outer end of the side member 122 downwardly and then inwardly where it joins the inner surface of the bottom member 123. In the specific arrangement shown, the frame member 120 and filler are made of extruded aluminum, the side member 122 and the filler 127 being formed as a single extrusion and permanently attached to the inner surface of the bottom member 123 of the frame member 120 by welding or the like. The other side member 121 can also be extruded separately and attached to the bottom member 123.

The inner surface of the filler 127 has a pair of upstanding webs 127*b*, the purpose of which will be described shortly. The lower surface 127*a* of the filler 127 is slightly tapered outwardly in the direction of the opened side of the frame member 120. The tapered surfaces facilitate removal of the edge of the concrete panel cast by the use of the frame members.

On the outside of the bottom member 123 of the channel member 120 is an outer channel 129 having a slot 130 opening out of the channel 129. The edges of the frame member defining the slot 130 are turned inwardly. Along the upper outside corner of the frame member 120 is an upper groove 129*c*, and along the lower outside corner of the frame member is a lower groove 129*d*, the purpose of which will be described hereinafter.

As in the first embodiment, in the most preferred form of the present embodiment, the frame member is an extruded aluminum channel member having a length of up to 14 feet, and having a gauge with sufficient strength to support concrete in a panel having a thickness of 6 inches. Likewise, as in the first embodiment, other molded or extruded metals can be used, or rigid molded or extruded plastic materials can be used.

Figure 18:
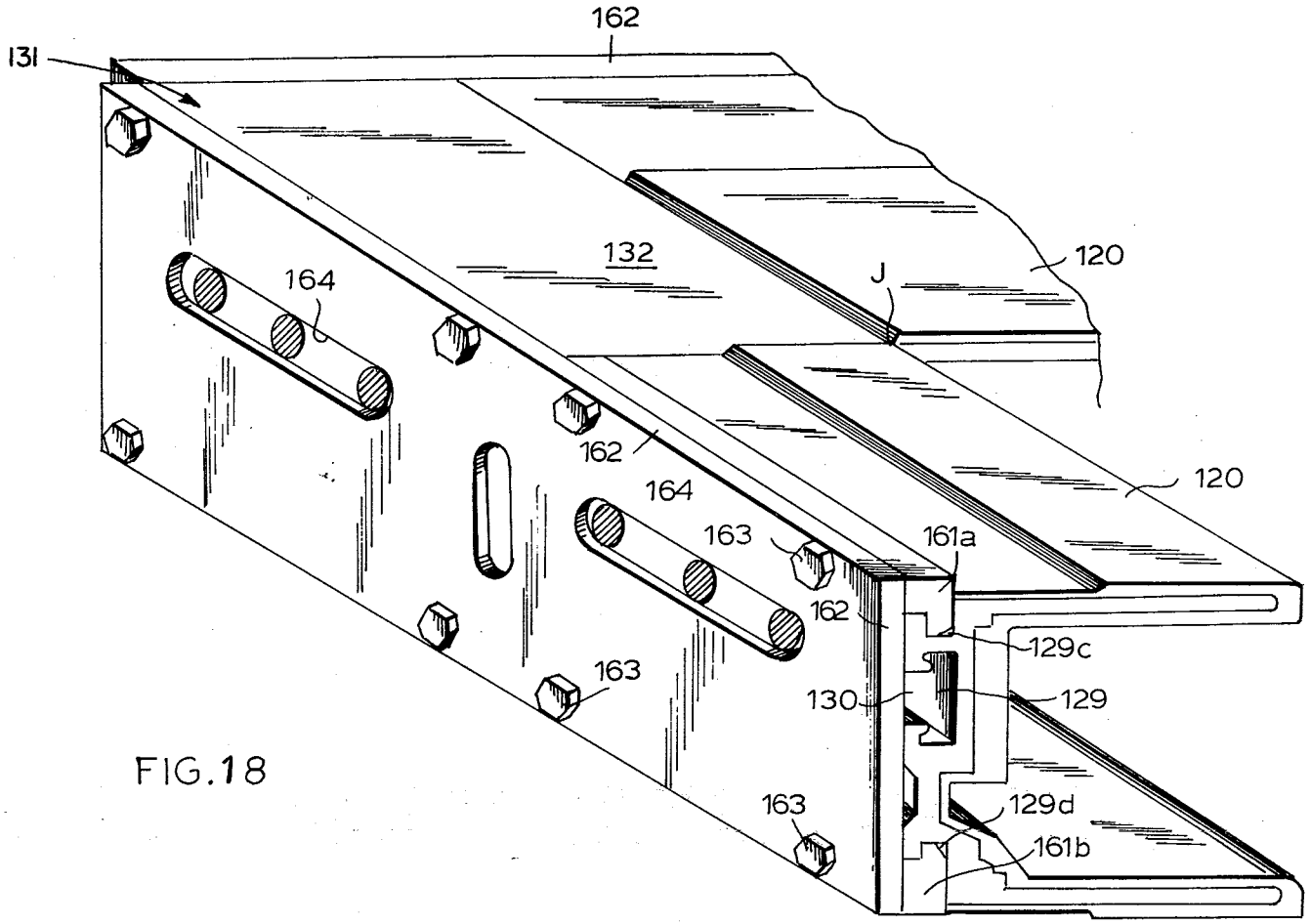
FIG. 18 is a perspective view of frame members of the type shown in FIG. 13*a* connected at a corner of a panel frame by a corner structure.

In order to form the corners of the panels, there are provided panel corner frame members 131, as shown in FIG. 18. These corner frame members, in the present embodiment, are simple boxes with a plane flat top 132 and depending plane flat walls (not visible in the drawing). When the corner frame member is in place between two panel edge molding frame members 120, the ends of the panel edge molding frame members are abutted against two adjacent walls of the corner frame member. The longitudinal dimensions of the side walls abutted by the panel edge molding frame members 120 are the same as the dimensions of the side members 121 and 122 of the panel edge molding frame members 120, so that when the corner frame member 131 is in position at the corner of a panel edge molding frame, the corner between the two walls of the corner frame member is at the intersection of the inner ends of the panel edge molding frame members. When the panel corners are right angled corners, the corner frame member will be square, the outside walls thereof being the same size as the walls abutted by the ends of the panel edge molding frame members 120. However, if the corner is not a right angle, the corner frame member will have a quadrilateral shape with the two outer walls either both shorter than the abutted walls, where the corner angle is obtuse, or both longer than the abutted walls where the corner angle is acute.

Figure 16:
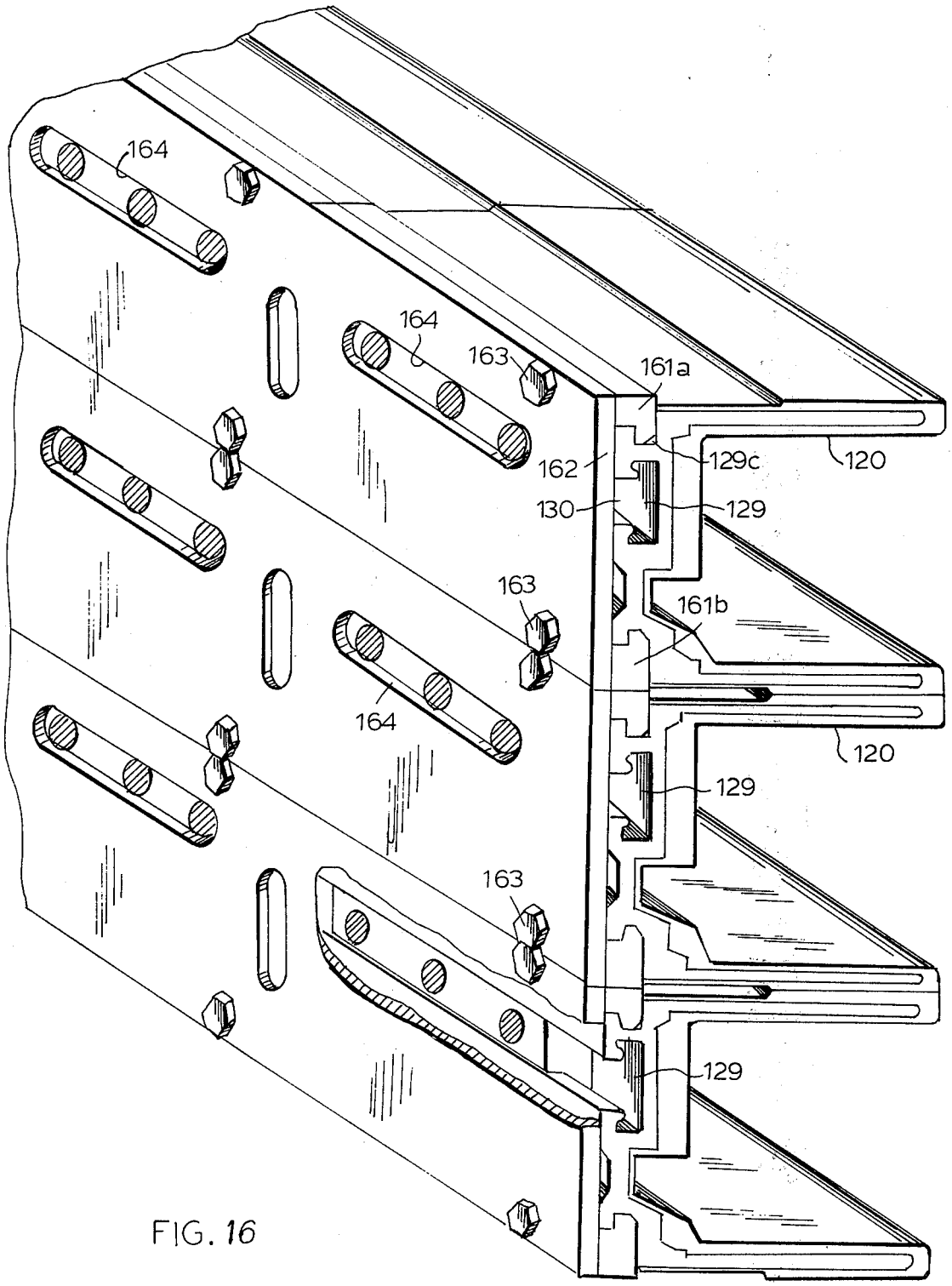
FIG. 16 is a perspective view of a stack of frame members of the type shown in FIG. 13*a* with the frame members in each layer being joined in end-to-end relationship.

In order to join the panel edge molding frame members 120 to each other and to the panel corner frame members 131, connecting means is provided as shown in FIGS. 13*a*, 13*b* and 16. The connecting means for this embodiment is constituted by a pair of bars 161*a* and 161*b* which are L-shaped in cross-section, with one leg extending into the respective upper and lower grooves 129*c* and 129*d*, and with the other leg extending outwardly of the bottom member 123 of the frame member 120. Over the outer face of the bottom member 123 of channel member 120 is a connecting plate 162 which has a series of bolts 163 along the upper and lower edges thereof, which bolts extend through the plate 162 and thread into tapped holes 161*c* in the bars 161*a* and 161*b*. It will be seen that the plate 162 is sufficiently long to extend over the joint J between two abutting ends of adjacent frame members 120, and that when the bolts 163 are tightened, the plate 162 and bars 161*a* and 161*b* will be clamped tightly to the bottom members 123 of the frame members 120 on opposite sides of the joint J.

In order to join the panel edge molding frame members 120 to the corner frame member 131, plates 162 and bars 161*a* and 161*b* are used to attach the plates 162 to the frame members 120. Holes are tapped in the outside side walls of the corner frame members 131 at appropriate places and bolts 132 are used to attach the ends of plates 162 to the outside side walls of the corner frame members 131.

An elongated aperture 164 is provided in each end portion of the plate 162 in alignment with the slot 130 opening out of the outer channel 129. The purpose of this groove will be described hereinafter.

Figure 17:
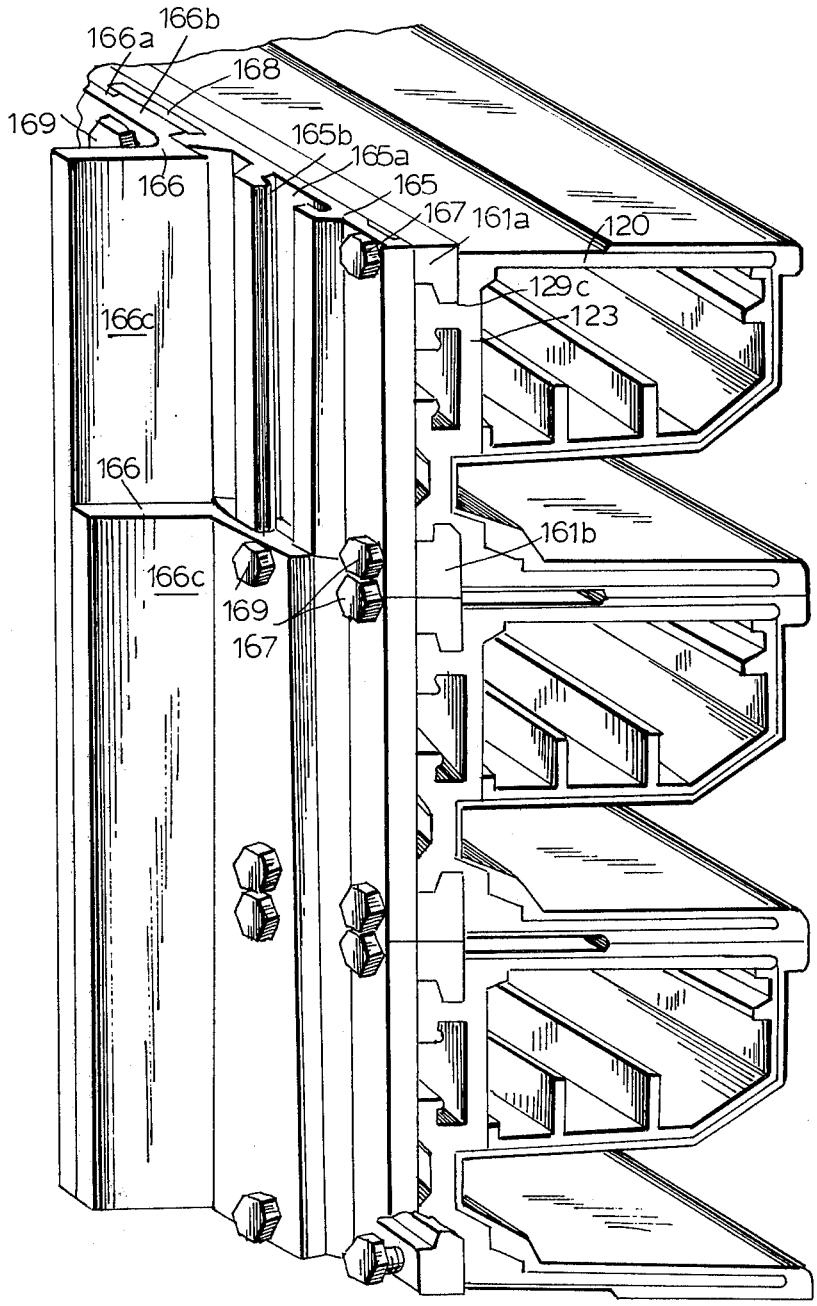
FIG. 17 is a view similar to FIG. 16 showing the frame members of the type shown in FIG. 13*c* in the different layers of the stack connected to frame members in layers thereabove and therebelow.

In order to hold the frame members of panel molding frames which have been stacked one on top of the other with the flats 141 and 142 of the coating 140 abutting each other, as shown in FIG. 17, there is provided at intervals along the frame members 120 a stacking connecting means in the form of stacking plates 165 on each of the frame members 120 and vertically extending angle members 166 extending vertically between frame members 120 in the stack. Each of the plates 165 has a pair of grooves 165*a* in the face thereof extending transversely to the length of the frame member 120. Slots 165*b* open out of the grooves 165*a*. Bolts 167 extend through the ends of the plates, both at the top and bottom thereof, and thread into tapped holes in bars 161*a* and 161*b* which are identical to the corresponding bars in the connecting means for connecting the frame members 120 to each other described above in connection with FIG. 16. Thus, the bolts 167 and the bars 161*a* and 161*b* together clamp the plates 165 to the outside of the bottom members 123 of the frame members 120.

A clamping bar 168 is provided in each of the transversely extending grooves 165*a*, and one leg 166*a* of the angle member 166 has a projection 166*b* thereon which extends into the slot 165*b*. Bolts 169 extend through the one leg 166*a* of the angle member 166 into tapped holes (not shown) in the clamping bar 168, so that by tightening the bolts 169, the clamping bar 168 clamps the edges defining the slot 165*a* between the clamping bar and the one leg 166*a* of the angle member 166, thus securing the angle member 166 in a vertical position with respect to the horizontal frame members 120. By thus clamping the vertically extending angle member 166 to two superposed frame members 120, the frame members are connected to each other. By spacing the grooves 165*a* along the face of the plates 165 properly, when one angle member 166 is used to connect a first and second superposed frame members 120, and a second angle member 166 is used to connect second and third superposed frame members, the other flange members of 166*c* of the angle members 166 abut each other at the position of the intermediate frame member, thus bracing the stacking connecting means against relative lateral movement of the frame members 120.

Figure 14:
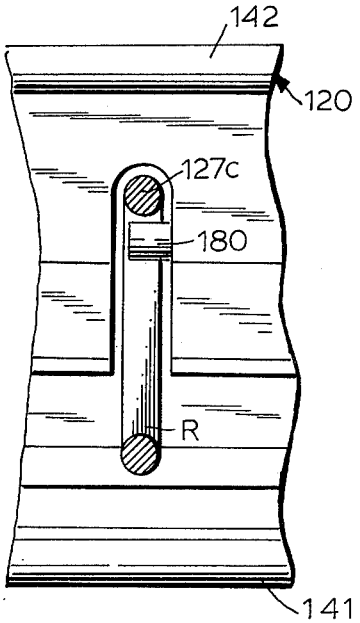
FIG. 14 is a front elevation view of part of the frame member of FIG. 13*c* viewed from line 14—14 in FIG. 13*c;*
Figure 15:
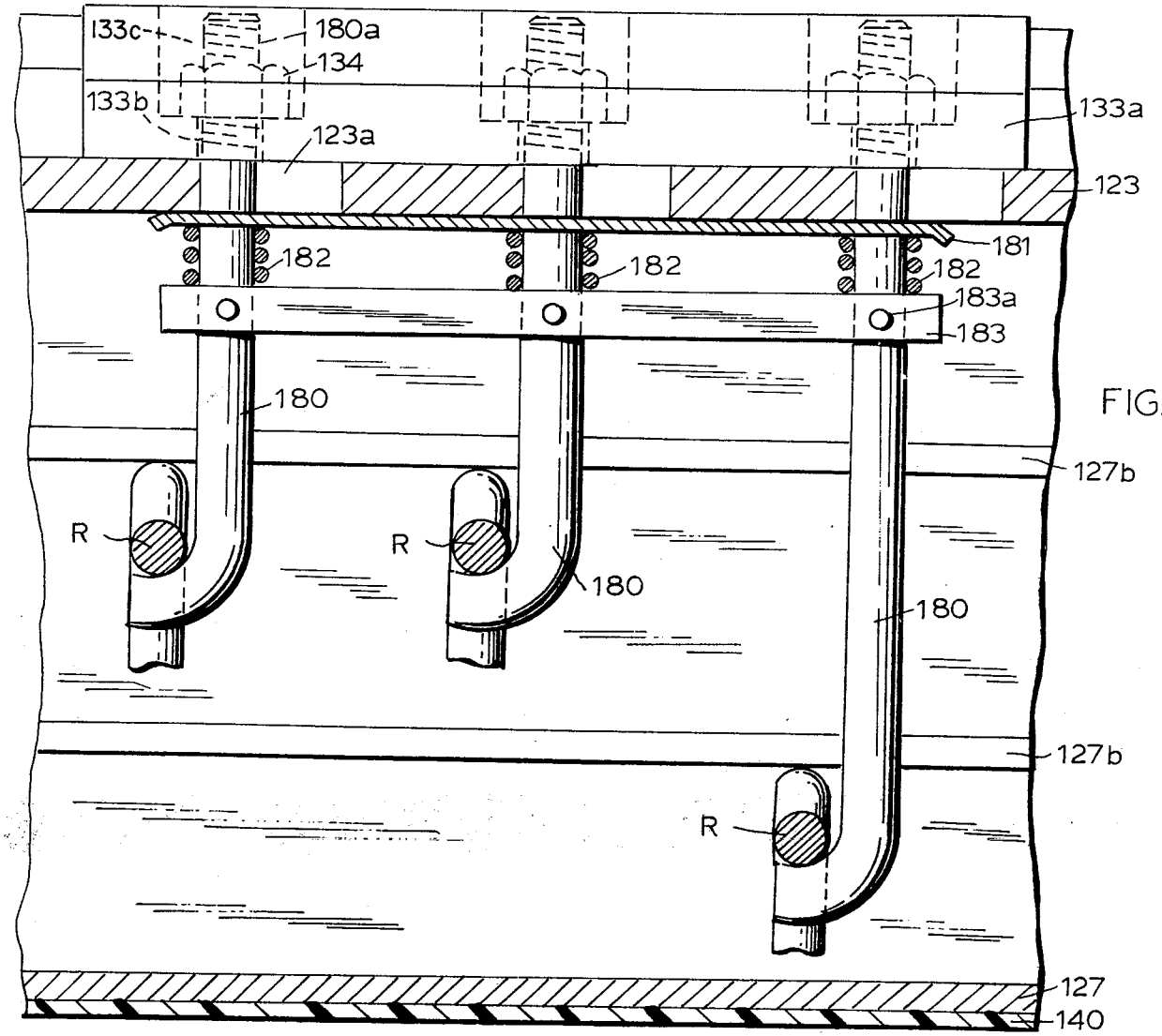
FIG. 15 is a sectional taken on line 15—15 of FIG. 13*c;*

Since it is frequently necessary to have reinforcing rods in the concrete panels being cast, anchor means is also provided in the present embodiment for anchoring the ends of the reinforcing rods in the frame members. As shown in FIGS. 13*c*–15, the fillers 127 have slots 127*c* therein at intervals therealong, and the looped ends of the reinforcing rods R are inserted into these slots to a position in which they project the desired amount above the inner surface of the filler 127. A hook member 180 of the desired length is provided within the space within the filler 127 having the shank end 180*a* extending through an aperture 123*a* in the bottom 123 of the frame member into the outer channel 129. The hook member 180 rests on the upper edges of the webs 127*b* on the outside of the filler 127. The hook member 180 is held in place by a retaining plate 181 urged against the inside face of the bottom 123 by a spring 182 held on the hook 180 by a holding plate 183 attached to the hook 180 by a pin 183*a*. As seen in FIGS. 14 and 15, a plurality of adjacent hooks of different lengths can be held by a single retaining plate 181 and a single holding plate 183. However, it is not necessary that groups of hooks 180 be provided. Single hooks and retaining plates, etc. can be provided at intervals along the frame members 120.

The outer end of the shank 180*a* extends through an aperture 133*b* in a hook retaining bar 133*a* in the channel 129, and in a recess 133*c* in the bar 133*a* is provided a nut 134 threaded onto the threaded end of the shank 180*a*. Thus, the nut 134 can be tightened to draw the hook 180 toward the inner surface of the bottom 123 so as to increase the tension on the springs 182 and properly locate the hook 180.

The apertures 164 in the plates 162 are provided to give access to the nuts 134 threaded onto the ends of the hooks 180 so that adjustment can be made in the tension on the reinforcing rods by further tightening the nuts 134 while the frame members 120 are connected end-to-end, and while they are assembled in a vertical stack. Likewise, access can be gained to the nuts 134 for removing them so as to permit removal of the hooks when the frame member 120 is to be removed from the edge of the completely cast panel. Thus, the plates 162 never need to be completely removed from the bars 161*a* and 162*b*, but can simply by loosened so that the assembly of the plates 162 and bars 161*a* and 161*b* can be slid along the length of the channels 120.

It will thus be seen that by providing the proper length of hooks 180 and properly positioning them within the interior of the filler 127, the reinforcing rods can be located at any desired position and held there.

A cover plate (not shown) should be provided which covers the portion of each of the slots 127*c* which is not filled by the reinforcing rod R so as to block entry of concrete into the interior of the filler during casting of concrete.

It is believed that the manner of using the present embodiment will be clear from the description of the use of the previously described embodiment. The frame members 120 and 131 are assembled end-to-end in the desired shape of the panel, with the adjacent abutting frame members being connected by the plates 162 and bars 161*a* and 161*b* and bolts 163, and the reinforcing rods R are properly positioned as desired. The thus assembled panel molding frame is placed on a base, and the concrete is cast into the center of the frame to form the desired panel in the same manner as in the first embodiment as described in connection with FIG. 12. The concrete will fill the space within the coating 140 within the frame member 120 so as to produce the desired shape of the edge of the concrete panel. In the present embodiment, where the frame members as shown in FIG. 13*c* are used and reinforcing rods are provided, the reinforcing rods will project out of a longitudinal recess along the edge of the finished concrete panel so that further reinforcing rods can be looped through the projecting reinforcing rods R to connect the edges of the panels to adjacent panels. After the first panel has been cast, a second frame is placed on the first frame, and the frames are connected in the manner as shown in FIG. 17 by the stacking connecting plates 165 and the angle members 166, and the second panel is cast. The third frame is assembled and connected to the second frame by the stacking connecting plates 165 and the angle members 166, and the third panel is cast.

Thereafter, the lower angle member 166 is removed from the first and second frames, and elevated and a fourth frame is placed on top of the third frame and attached to the third frame by the thus raised angle member. The panels are cast in sequence up the stack in this fashion.

After they have set sufficiently to be strong enough to handle, they are removed from the stack, and the frame members 120 are removed from the edges of the now completely cast panel simply by moving them off the edge of the panel. A release agent for releasing the concrete from the coating 140 can be placed on the coating 140 prior to casting. This makes it possible to keep the frame members quite clean. Since substantially no concrete will adhere to the coating, the frame member is ready for immediate use for casting further panels.

It is of course possible, as is the case with the previously described embodiment, to remove frame members from panels which have been cast in the lower portion of a stack of panels and which have set for use in casting new panels at the top of the stack.

It will be seen that in the present embodiment, the liner means, i.e., the coating 140, is not removed from the frame members and replaced with fresh liner means for casting further panels. Once the frame member is removed from the cast panel, it is immediately available for use in casting a new panel.

It will be seen from FIGS. 13*a*–13*c* that the shapes of the edges of the panels cast by the use of the panel molding frames as described hereinbefore are limited to the cross-sectional shapes of the frame members 120 as shown in the figures. However, occasionally it is desired to have different shapes of the edges of the panels, or to provide recesses in the edges of the panels for the insertion of special structural elements in the finished concrete building structure. To make possible the provision of such shapes or recesses, the present embodiment of the invention provides plug-in elements which fit tightly into the frame members 120.

Figure 19A:
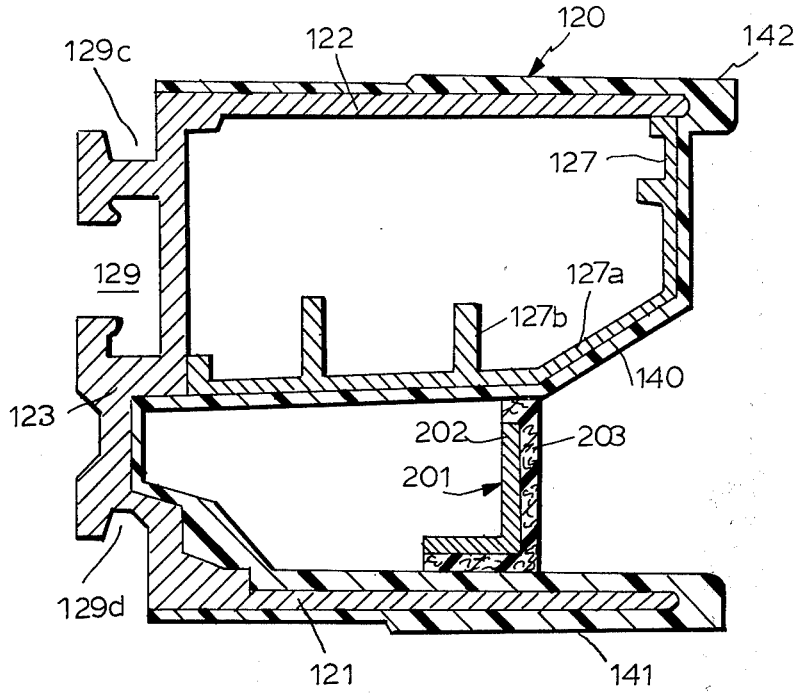
FIGS. 19*a*–19*c* are views similar to FIGS. 13*a*–13*c* showing additional edge shaping members connected to the panel edge molding frame members.
Figure 19B:
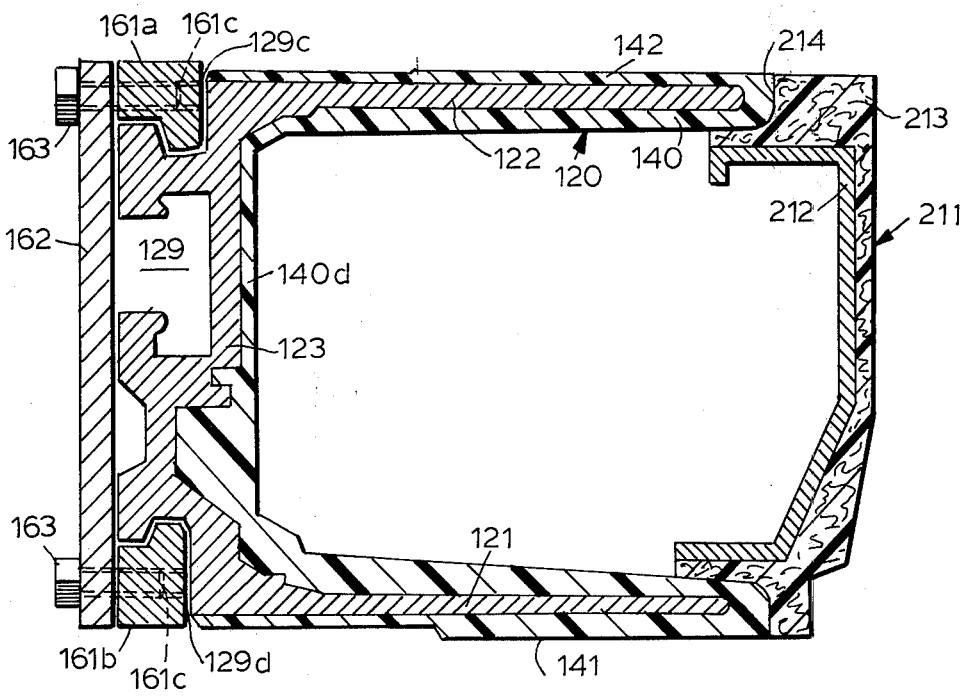
Figure 19C:
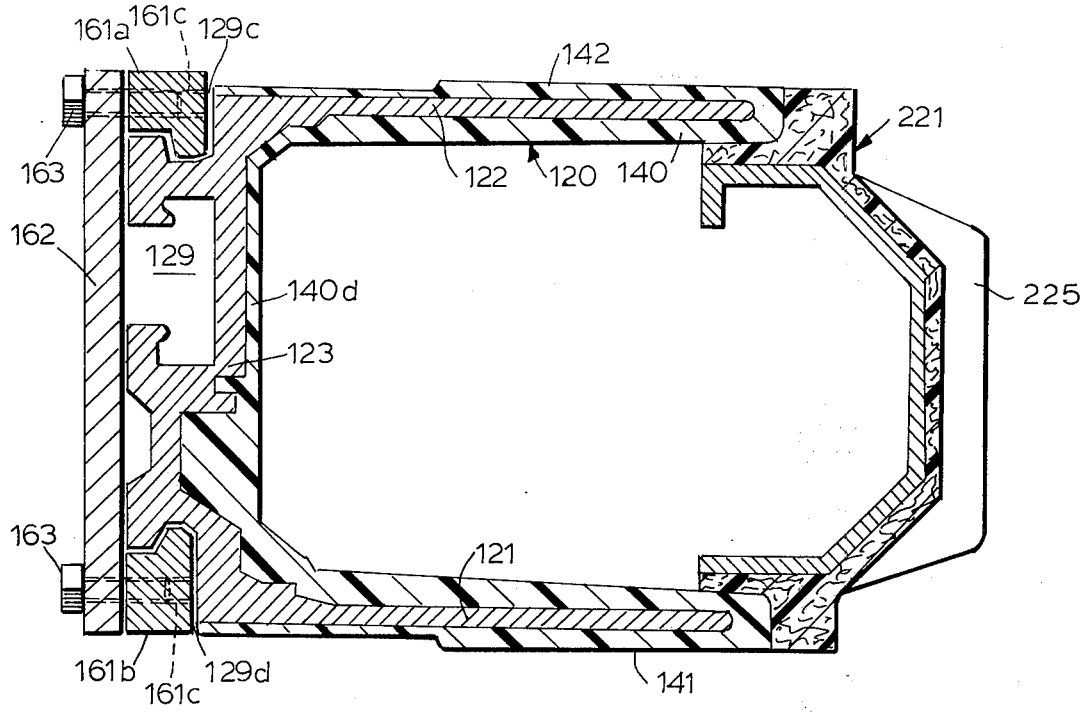

Referring to FIGS. 19*a*–19*c*, a first plug-in element 201 is shown in FIG. 19*a* for modifying the shape of the edge of the panel cast with the frame member of FIG. 13*c*. The plug-in element 201 has an L-shaped rigid extrusion 202, made, for example, of aluminum, which has the lower outside surface, the vertical outside surface and the top edge of the longer leg of the L coated with a moldable material 203 which is preferably the same as the material of the coating 140 forming the lining means on the frame members 120. The dimension of the plug-in element 201 from the top to the bottom is such as to enable it to fit tightly into the smaller portion of the recess in the frame member 120 between the lower part of the filler 127 and the upper surface of the coating 140 on the side member 121 and be held there by friction between the coating 140 and the coating 203. The plug-in element 201 can extend the full length of the frame member 121, or it can be less than the length of the frame member 121, in which case end walls must be provided which fill the cross-section of the interior of the frame member between the plug-in element 201 and the bottom of the recess within the frame member. The panel cast with a frame member or members having one or more plug-in elements 201 therein will have an edge with a cross sectional shape like that of the space within the frame member 120 to the right of the plug-in member 201 in FIG. 19*a*.

FIG. 19*b* shows a similar plug-in element 211 for use with a frame member as shown in FIGS. 13*a* or 13*b*. In this form of the plug-in element, the extrusion 212 is generally C-shaped, and the coating 213 on the outside surface thereof in turn has the outer surface with a shape complementary to the shape desired for the edge of the panel to be cast. The top and bottom portions of the plug-in element 211 have recesses 214 in the coating 213 which are complementary to the shapes of the ends of the coating 140 where it extends around the ends of the side members 121 and 122 of the frame member 120. The dimensions of the plug-in element 211 between the recesses 214 are such that when the plug-in element 211 is inserted into the opening in a frame member 120 such as shown in FIGS. 13*a* or 13*b*, the plug-in element is held in place by the frictional engagement between the material of the coating 140 and the material of coating 213.

The plug-in element 221 of FIG. 19*c* differs from that of FIG. 19*b* by the overall shape of the exterior surface thereof, and by the provision of a generally rectangular projection 225 molded in the coating material 223 which extends along only a portion of the length of the plug-in element 221.

As with the plug-in element 201 of FIG. 19*a*, where the plug-in elements 211 and 221 of FIGS. 19*b* and 19*c* extend less than the full length of the frame member 120, end walls must be provided thereon.

It is thought that the features of the invention can be understood from the foregoing specification, but it will be understood that changes may be made within the scope of the foregoing disclosure, and that the invention is to be limited only to the appended claims.

I claim:

1. A frame structure for casting a concrete building panel, comprising:

a plurality of panel edge molding frame members each having a generally U-shaped cross-section;

a plurality of panel corner frame members each having a configuration which, when viewed in plan, corresponds to the angle of the corner of the panels to be molded thereby;

said panel edge molding frame members and said panel corner frame members being assembled in a panel molding frame with a number of panel edge molding frame members along the portions of the frame corresponding to the edges of the panel to be molded sufficient to equal the length of the corresponding edge of the panel, with the ends of the panel edge molding frame members abutting the panel corner frame members, and with the opening of the U-shaped cross-section of said panel edge molding frame members facing inwardly of the panel molding frame;

connecting means rigidly connecting said panel edge molding frame members to each other and to said panel corner frame members; and liner means in the interior of each of said panel edge molding frame members and having the inner portions thereof abutting the interior of said panel edge molding frame members for positioning said liner means in the panel edge molding frame members, and the surfaces of the liner means facing the space within the panel molding frame having a shape complementary to the shape of the edge of the panel to be molded by the use of said frame structure, said panel molding frame, said connecting means, and said liner means together constitute a panel molding frame unit.

2. A frame structure as claimed in claim 1 in which said panel edge molding frame members each have a liner retaining means in the interior thereof;

said plurality of panel corner frame members each have two portions having the same cross-section as said panel edge molding frame members and having a liner retaining means in the interior thereof, said portions being abutted at one end thereof to each other and attached together at an angle to each other corresponding to the angle of the corner of the panels to be molded thereby;

the ends of the panel edge molding frame members in said panel molding frame being aligned with and abutting the other ends of the portions of the panel corner frame members, and with the opening of the U-shaped cross-section facing inwardly of the panel molding frame; and said liner means being liners in the frame members engaged with said liner retaining means for being retained in said frame members.

3. A frame structure as claimed in claim 2 in which said liner retaining means in each frame member comprises an inner channel portion in the innermost portion of the interior of said U-shaped cross-section and extending along the length of the frame member and having a slot-shaped opening therein directed toward the open part of said U-shaped cross-section, and said liners each having at least one projection thereon engaged in said slot-shaped opening for retaining the liners in said frame members.

4. A frame structure as claimed in claim 3 in which said liners are of a material which is softer than the material of the frame members and said projections are slightly larger than the width of said slot-shaped openings and being forcedly engaged in said slot-shaped openings for retaining the liners in the frame members.

5. A frame structure as claimed in claim 3 in which the inner channel portion in each frame member has a plurality of pairs of opposed recesses spaced along the edges defining said slot-shaped opening to form slot enlargements, and said liners each have projections spaced at distances therealong corresponding to the spacing of said slot enlargements and having a size for fitting tightly into said enlargements, whereby the liners are properly located along the frame members.

6. A frame structure as claimed in claim 2 in which the surfaces of at least some of the liners facing the space within the panel molding frame have a shape which is different from the shape of the corresponding surfaces on the other liners.

7. A frame structure as claimed in claim 2 in which the liners each have a shape having surfaces engaging the sides of the U-shaped cross-sectional frame members which are substantially complementary to the sides of the interior of the U-shaped cross-section frame members.

8. A frame structure as claimed in claim 7 in which the opposed inner surfaces of the sides of the U-shaped cross-section of the frame members are tapered outwardly toward the open part of the U-shaped cross-section.

9. A frame structure as claimed in claim 2 in which said liners are a relatively soft easily moldable material.

10. A frame structure as claimed in claim 9 in which said liners are a material taken from the group consisting of expanded polystyrene, rubber urethane and foamed urethane.

11. A frame structure as claimed in claim 10 in which at least some of said liners are single pieces of material.

12. A frame structure as claimed in claim 10 in which at least some of said liners are in two parts, an inner part for fitting into the inner part of a frame member and an outer part having the surface facing the space within the panel molding frames, the abutting surfaces of said parts having mating projections and recesses for holding the parts in the proper relative engaged positions.

13. A frame structure as claimed in claim 2 in which the outer surfaces of the sides of the U-shaped cross-sectional frame members have flats thereon for abutting corresponding flats of adjacent frame members when panel molding frame units are stacked.

14. A frame structure as claimed in claim 2 in which said frame members are extruded aluminum.

15. A frame structure as claimed in claim 2 in which each frame member has an outer channel therealong having a slot opening out of said outer channel, and said connecting means for connecting each two adjacent frame members comprises a bar positioned in said outer channel and extending between adjacent frame members, a plate along the outside of said frame members, and connecting members on opposite sides of the joint between adjacent frame members and extending through said plate, said slot and bar for drawing said plate and said bar toward each other to clamp said frame members therebetween.

16. A frame structure as claimed in claim 15 in which said connecting members are each a threaded shaft threaded through said bar for drawing said bar against the outer wall of the interior of said channel on opposite sides of said slot, and a handle means on the shaft bearing against the outside of said plate.

17. A frame structure as claimed in claim 2 further comprising stacking connecting means connecting panel molding frame units in a stack one above the other.

18. A frame structure as claimed in claim 17 in which at least two frame structures are stacked and each frame member has an outer channel therealong on the outer surface of the bottom of the U-shaped cross-section and having a slot opening out of said outer channel, and said stacking connecting means comprises a plate extending transversely of at least two frame members, a bar in the outer channel of each frame member, and threaded means connected to said plate and to said bars for clamping said plate to said frame members.

19. A frame structure as claimed in claim 18 in which said threaded means is a threaded shaft extending through said plate and threaded through each bar for drawing said bars against the outer wall of the interior of said outer channel on opposite sides of said slot in each frame members, and a handle means on each threaded shaft for urging said plate against the frame members over the slots.

20. A frame structure as claimed in claim 2 in which said frame members and liners have recesses therein for insertion of reinforcing rods thereinto for being held by said frame structure while being cast into the panel.

21. A frame structure as claimed in claim 20 further comprising anchors extending through said frame members and said liners for engaging the reinforcing rods for holding said reinforcing rods in said liners.

22. A frame structure as claimed in claim 21 in which said anchors are for engaging horizontally oriented U-shaped reinforcing rods with the U-shaped end in the respective recesses of the liners, and said anchors are each constituted by a shank having a hook on one end for engagement with the U-shaped end of the associated reinforcing rod and means on the other end for engaging the frame member in which the anchor is located for pulling the reinforcing rod snugly into the associated recess and securing the associated reinforcing rod, liner and frame member tightly together.

23. A frame structure as claimed in claim 22 further comprising a plug for engagement between the legs of each U-shaped reinforcing rod, said plug having portions for engagement around the legs of the rod and having an overall shape complementary to the cross-section of the reinforcing rod receiving recesses in the liners for plugging each of said recesses when a reinforcing rod is positioned therein for preventing concrete from flowing into the recesses during the casting of the concrete panel.

24. A frame structure as claimed in claim 2 further comprising a recess mold member engaged with a liner and extending into the space within the panel molding frame, and a strap extending around said recess mold member and having the ends thereof engaged in said liner retaining means in the frame member from which the recess mold member extends.

25. A frame structure as claimed in claim 2 further comprising a protector for at least some of the frame members and liners of said frame structure, said protector being a sheet of protective material and having a shape corresponding to the shape of the surface of the liners facing the space within the frame structure and positioned over said surface with the ends of said sheet extending along the outer surfaces of said frame members.

26. A frame structure as claimed in claim 25 in which each said protector has a groove therein facing the space within the panel molding frame with which it is associated for receiving a strip-shaped gasket to be molded into the edge of the concrete panel.

27. A frame structure as claimed in claim 1 in which said liner means in each panel edge molding frame member is a coating of a moldable material softer than the material of the frame members and has a varying thickness for providing the desired shape to the surface of the liner means facing the space within the panel molding frame, which shape is different from the shape of the interior surface of the panel edge molding frame member.

28. A frame structure as claimed in claim 27 in which the surfaces of at least some of the coatings facing the space within the panel molding frame have a shape which is different from the shape of the corresponding surfaces on the other coatings.

29. A frame structure as claimed in claim 27 in which the opposed inner surfaces of the side members of the U-shaped cross-section of the panel edge molding frame members and the coatings thereon are tapered outwardly toward the open part of the U-shaped cross-section.

30. A frame structure as claimed in claim 27 in which the material of the coating extends around the ends of the side members of the U-shaped cross-section of the panel edge molding frame members and along the outside surfaces of said side members.

31. A frame structure as claimed in claim 30 in which part of the coating on the outside surfaces of said side members has a thickened portion with a flat outer surface for abutting a corresponding flat surface on a panel edge molding frame member which lies against the flat outer surface.

32. A frame structure as claimed in claim 27 in which said panel edge molding frame members are extruded aluminum.

33. A frame structure as claimed in claim 27 in which said coating material is polyurethane adhered to said panel edge molding frame member.

34. A frame structure as claimed in claim 27 in which each panel edge molding frame member has a groove along the upper and lower outer corners thereof, and said connecting means for connecting each two adjacent panel edge molding frame members comprises two L-shaped cross-sections bars with one leg in a corresponding groove in adjacent panel edge molding frame members, and a plate extending along the outside of said panel edge molding frame members, and connecting members along the edges of said plate opposite said bars and extending through said plate into said bars for drawing said plate and said bars toward each other for clamping said panel edge molding frame members therebetween.

35. A frame structure as claimed in claim 27 in which said corner frame members each comprise a plate member and depending side walls depending therefrom and abutted by the ends of panel edge molding frame members at the corners of the panel frame.

36. A frame structure as claimed in claim 35 in which said corner frame members each further have depending side walls along the outside of the corner frame member flush with the outside surfaces of the bottom members of the abutting panel edge molding frame members, and said panel edge molding frame members each have a groove along the upper and lower outer corners thereof, and said connecting means for connecting adjacent frame members comprises two L-shaped cross-section bars with one leg in a corresponding groove in a panel edge molding frame member abutting a corner frame member, a plate extending along the outside of the adjacent frame members, and connecting members along the edges of the plate opposite said bars and extending through said plate into said bars for drawing said plate and said bars toward each other for clamping the panel edge molding frame member therebetween, and further connecting members extending through said plate for securing said plate to said outside depending side walls of said corner frame member.

37. A frame structure as claimed in claim 27 further comprising stacking connecting means connecting panel molding frame units in a stack one above the other.

38. A frame structure as claimed in claim 37 in which each panel edge molding frame member has a leg receiving groove along the upper and lower outer corners thereof, and said stacking connecting means comprise a plurality of L-shaped cross-section bars with the one legs in corresponding leg receiving grooves in the stacked panel edge molding frame members, a stacking plate on the outside of each of the panel edge molding frame members in the stack, connecting members along the edges of said stacking plates opposite said L-shaped cross-section bars and extending through said plates into said L-shaped cross-section bars for drawing said stacking plates and L-shaped cross-section bars toward each other for clamping the panel edge molding frame members therebetween, said stacking plates each having a pair of spaced parallel bar receiving grooves therein extending in a direction of the stacking of the frame members, each bar receiving groove having a slot opening out of the bar receiving groove which is narrower than the bar receiving groove, a connecting bar in each bar receiving groove, the connecting bar in one bar receiving groove extending through th corresponding bar receiving groove in the stacking plate on the next higher panel edge molding frame member in the stack and the connecting bar in the other bar receiving groove extending through the corresponding bar receiving groove in the stacking plate on the next lower panel edge molding frame member in the stack, and a pair of angle members, one angle member having one flange over the slots of the bar receiving grooves in which one connecting bar is positioned, and the other angle member having one flange over the slots of the bar receiving grooves in which the other connecting bar is positioned, connecting means extending through said one flange on each angle member into the corresponding connecting bar for drawing said connecting bars and flanges toward each other to clamp said stacking plates therebetween, the angle members having second flanges thereon which abut each other for resisting relative lateral movement of said panel edge molding frame members to which said stacking connecting means is connected.

39. A frame structure as claimed in claim 27 in which said liner means further comprises a filler member extending between one of said side members of at least one of said U-shaped cross-section panel edge molding frame members and the bottom member thereof with said coating over the surface thereof within said panel edge molding frame member, said filler member defining a closed space between said filler member and the inner surface of said panel edge molding frame member, and anchors extending into said closed space through said panel edge molding frame member for engaging reinforcing rods for holding reinforcing rods in position in said panel molding frame during casting of a concrete panel therein.

40. A frame structure as claimed in claim 39 in which said anchors are for engaging horizontally oriented U-shaped reinforcing rods with th U-shaped end in the closed space, said filler member having at least one slot therein through which the reinforcing rod extends, and said anchors are each constituted by a shank having a hook on one end for engagement with the U-shaped end of the associated reinforcing rod and means on the other end for engaging the frame member in which the anchor is located for pulling the reinforcing rod snugly into the closed space and securing the associated reinforcing rod and frame member tightly together.

41. A frame structure as claimed in claim 27 further comprising a plug-in member for at least one of said panel edge molding frame members, said plug-in member having a rigid member and a coating thereon of the same material of the coating on said panel edge molding frame member, said coating having a dimension for fitting tighty into the space within said panel edge molding frame member with the surface thereof facing the interior of the panel molding frame having the desired shape complementary to the shape of the edge of the panel to be cast by the frame structure.

42. A frame structure as claimed in claim 27 in which said panel edge molding frame members each have a bottom member and two separate side members, the side members being connected to the bottom member.

43. A frame structure as claimed in claim 27 in which said panel edge molding frame members each have a bottom member and two side members formed of a single piece of material.

* * * * *